US007357758B2

(12) United States Patent
Polk, III et al.

(10) Patent No.: US 7,357,758 B2
(45) Date of Patent: Apr. 15, 2008

(54) TREADMILL

(76) Inventors: Louis F. Polk, III, 4740 Lodge La., Excelsior, MN (US) 55331; Paul M. Theisen, 612 W. 2nd, Waconia, MN (US) 55387; Randy Williams, 618 Dresden Cir., Chaska, MN (US) 55318; Kenneth V. Schomburg, 110 Minnetonka Ave. North, Wayzata, MN (US) 55391; Kevin Stevens, 1055 Juniper Ct., Shakopee, MN (US) 55379; Darrin Swagel, 3333 Zarthan Ave. South, St. Louis Park, MN (US) 55416

( * ) Notice: Subject to any disclaimer, the term of this patent is extended or adjusted under 35 U.S.C. 154(b) by 530 days.

(21) Appl. No.: 10/215,794

(22) Filed: Aug. 8, 2002

(65) Prior Publication Data

US 2003/0060331 A1 Mar. 27, 2003

Related U.S. Application Data

(60) Provisional application No. 60/311,969, filed on Aug. 8, 2001.

(51) Int. Cl.
*A63B 22/02* (2006.01)

(52) U.S. Cl. ..... 482/54; 601/26

(58) Field of Classification Search ..... 482/51, 482/54; 601/5, 23, 24, 26
See application file for complete search history.

(56) References Cited

U.S. PATENT DOCUMENTS

| | | | | |
|---|---|---|---|---|
| 4,066,257 A | | 1/1978 | Moller | 272/69 |
| 4,502,679 A | | 3/1985 | De Lorenzo | 272/69 |
| 4,579,352 A | | 4/1986 | Adang | 277/573 |
| 4,591,147 A | * | 5/1986 | Smith et al. | 482/54 |
| 4,602,779 A | | 7/1986 | Ogden | 272/69 |
| 4,664,371 A | | 5/1987 | Viander | 272/69 |
| 4,664,646 A | | 5/1987 | Rorabaugh | 474/88 |
| 4,844,449 A | | 7/1989 | Truslaske | 272/69 |
| 4,886,266 A | | 12/1989 | Trulaske | 272/69 |
| 5,000,440 A | | 3/1991 | Lynch | 272/69 |
| 5,007,630 A | | 4/1991 | Real et al. | 272/69 |
| 5,029,801 A | * | 7/1991 | Dalebout et al. | 248/649 |
| 5,088,729 A | * | 2/1992 | Dalebout | 482/54 |
| 5,163,885 A | * | 11/1992 | Wanzer et al. | 482/54 |
| 5,184,988 A | * | 2/1993 | Dunham | 482/54 |
| 5,352,167 A | * | 10/1994 | Ulicny | 482/54 |
| 5,372,559 A | * | 12/1994 | Dalebout et al. | 482/54 |
| 5,378,212 A | | 1/1995 | Pin-Kuo | 482/54 |
| 5,518,471 A | | 5/1996 | Hettinger et al. | 482/54 |

(Continued)

*Primary Examiner*—Jerome Donnelly
*Assistant Examiner*—Tam Nguyen
(74) *Attorney, Agent, or Firm*—Boyle Fredrickson, S.C.

(57) ABSTRACT

A treadmill is provided that has a treadmill drive motor carriage that can pivot relative to a frame of the treadmill such that the incline of the treadmill can be controlled while the carriage can be moved to a position that permits upright storage of the treadmill on the carriage. This arrangement advantageously permits a walk through treadmill design to be used that can be stored uprightly. The treadmill can be equipped with a console and stanchion that can be folded against the deck of the treadmill. One incline arrangement pivots the carriage using an incline drive carried by the carriage that engages a gear grounded to the treadmill frame. Another preferred incline arrangement uses a four bar linkage movable carried by the frame that is driven by a linear actuator to pivot the carriage.

29 Claims, 26 Drawing Sheets

U.S. PATENT DOCUMENTS 5,527,245 A 6/1996 Dalebout et al. ..... 482/54
5,618,245 A 4/1997 Trulaske et al. ..... 482/7
5,626,538 A 5/1997 Dalebout et al. ..... 482/54
5,676,624 A 10/1997 Watterson et al. ..... 482/54
5,733,228 A 3/1998 Stevens ..... 482/54
5,746,682 A 5/1998 Hung ..... 482/54
5,816,981 A 10/1998 Hung ..... 482/54
5,855,537 A 1/1999 Coody et al. ..... 482/54
5,868,648 A * 2/1999 Coody et al. ..... 482/54
6,015,368 A 1/2000 Clem et al. ..... 482/54
6,033,344 A 3/2000 Trulaske et al. ..... 482/7
6,033,347 A 3/2000 Dalebout et al. ..... 482/54
6,068,579 A 5/2000 Killian et al. ..... 482/54
6,077,200 A 6/2000 Lin ..... 482/54
6,095,951 A 8/2000 Skowronski et al. ..... 482/54
6,163,885 A * 12/2000 Webb ..... 2/166
6,179,753 B1 1/2001 Barker et al. ..... 482/54
6,241,638 B1 6/2001 Hurt ..... 482/54
6,267,710 B1 7/2001 Liu ..... 482/54
6,273,842 B1 8/2001 Wang et al. ..... 482/54
6,273,843 B1 8/2001 Lo
6,398,696 B1 * 6/2002 Tsou ..... 482/54
6,432,026 B1 8/2002 Wang et al.
6,461,275 B1 10/2002 Wang et al.
6,471,622 B1 10/2002 Hammer et al.
6,475,121 B2 11/2002 Wang et al.
6,730,002 B2 * 5/2004 Hald et al. ..... 482/51
6,811,518 B2 * 11/2004 Lin ..... 482/54
2001/0049323 A1 12/2001 Fox
2002/0049121 A1 4/2002 Anderson et al.
2002/0052267 A1 5/2002 Wang et al.
2002/0094916 A1 7/2002 Wang et al.
2002/0103057 A1 8/2002 Watterson et al.
2002/0147078 A1 10/2002 Wu
2002/0173408 A1 11/2002 Wang et al.
2004/0176217 A1 * 9/2004 Watterson et al. ..... 482/54

* cited by examiner

TREADMILL

CROSS REFERENCE TO RELATED APPLICATION

This application claims priority under 35 U.S.C. Section 119(e) to U.S. Provisional Application Ser. No. 60/311,969, filed Aug. 8, 2001, the entirety of which is hereby expressly incorporated herein by reference.

FIELD OF THE INVENTION

The present invention relates to a treadmill and, more particularly, to a treadmill having legs that pivot to change the tilt of the treadmill and that can easily be maneuvered and stored.

BACKGROUND OF THE INVENTION

Treadmills are widely used in gymnasiums, clinics, and homes for aerobic exercise, physical examinations, and physical therapy. Treadmills are used to perform walking or running aerobic-type exercise while the user remains in a relatively stationary position. Treadmills allow the user to exercise in a confined space that would otherwise require a large area.

A typical treadmill generally has a base, a pair of parallel, spaced rollers journalled in the base, and belt carried by the rollers. A suitable motor powers one of the rollers, thereby moving the belt with the rollers. A moving upper surface of the belt provides a running/walking surface. A forward post extends up from the base for supporting a control panel, which typically has controls for turning the treadmill on and off and for varying the speed of the belt. The control panel often has indicators for selectively displaying operational information such as speed, distance traveled, and time. The user may press a suitable button on the control panel to toggle between two or more different displays.

One drawback of a conventional treadmill is that it cannot easily or conveniently be stored and therefore typically wastes space when not in use. This is because it usually cannot easily or safely be tipped upright and therefore must be left on the floor in its generally horizontal operating position.

Another disadvantage of a traditional treadmill includes the general disposition or placement of the motor in relation to the roller assembly and belt. The motor is generally disposed in front of, behind, or at one side of the endless belt. Such inefficient motor placement can result in a treadmill that is larger than it needs to be and yet have a running/walking surface that is smaller than desired.

What is needed is an improved and more versatile treadmill that is capable of use in many different environments.

SUMMARY OF THE INVENTION

The invention, which is defined by the claims set out at the end of this disclosure, is intended to solve at least some of the problems noted above. A treadmill is provided that preferably has a walk-through design, consumes less floor space when stored than when in operation, and is easy to move.

The treadmill includes a frame and a movable deck, which is installed on the frame. A swing cage is pivotally mounted to the frame and deck. The swing case is configured to pivotally move to change a tilt of the frame and deck relative to the floor. The swing cage includes a tilt motor for driving a worm gear, which moves along a helical gear, which in turn is keyed to a main shaft within the front roller. The swing cage also includes pivotal arms, which terminate with wheels on which the swing cage is moved. The tilt motor drives the worm gear along the helical gear and thereby urges or pushes the swing cage toward or away from the frame and deck to increase or decrease the tilt of the treadmill.

In another preferred embodiment, an incline linkage drive assembly movably carried by the treadmill frame is driven by a linear drive to pivot the swing cage relative to the treadmill frame to change the inclination of the treadmill.

In a preferred method, the swing cage can be disposed at an acute angle relative to the frame rails of the treadmill within about ten degrees of perpendicular so as to permit the treadmill to be rested substantially self-supporting on the swing cage in a generally upright storage position. To facilitate storage and shipment, a console and stanchions of the treadmill can be folded against the deck of the treadmill.

Other objects, features, and advantages of the present invention will become apparent to those skilled in the art from the detailed description and the accompanying drawings. It should be understood, however, that the detailed description and accompanying drawings, while indicating at least one preferred embodiment of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout and in which.

Figure 1:
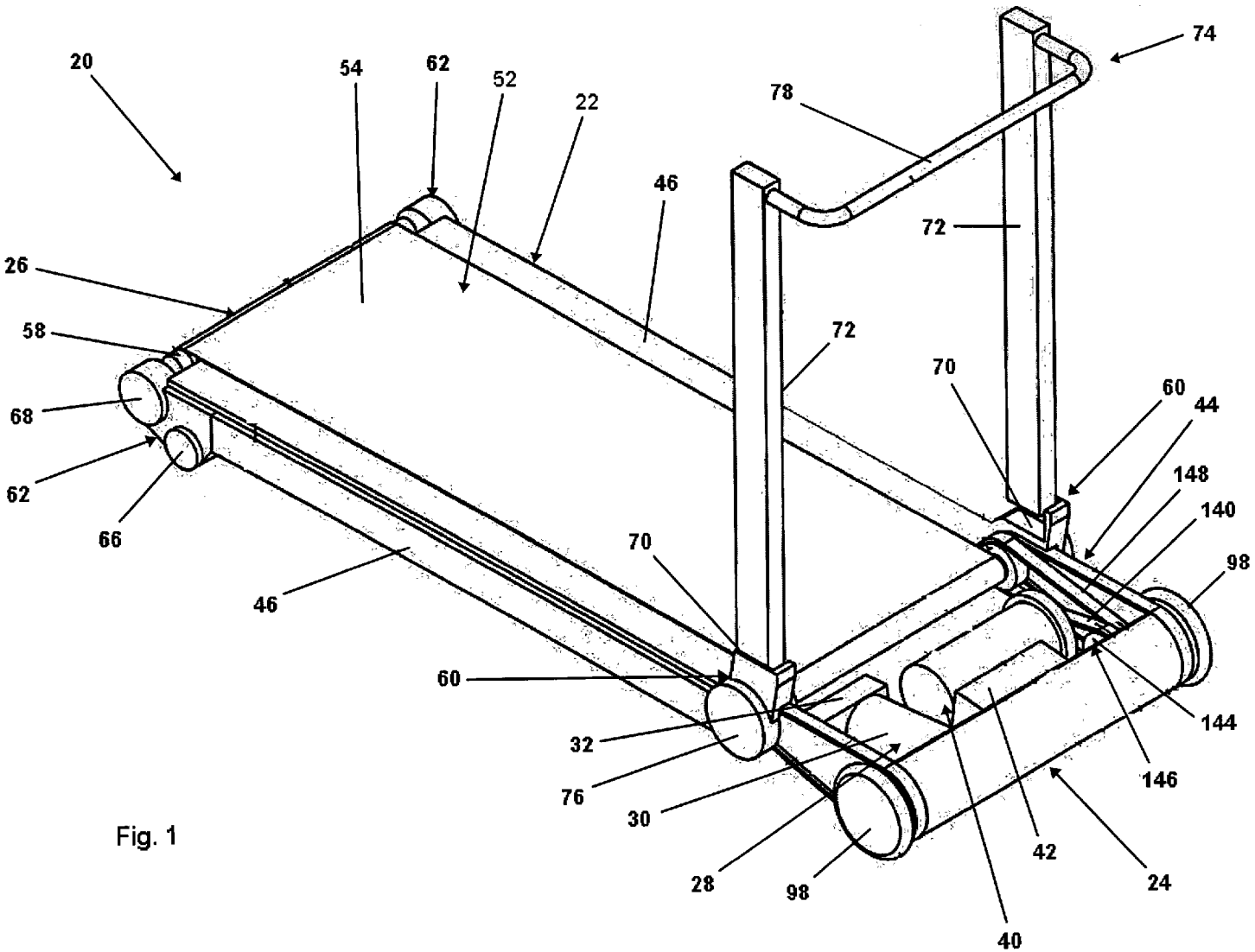
FIG. 1 is a perspective view of one preferred embodiment of a treadmill of this invention.

Before explaining embodiments invention in detail, it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF AT LEAST ONE PREFERRED EMBODIMENT

Figure 2:
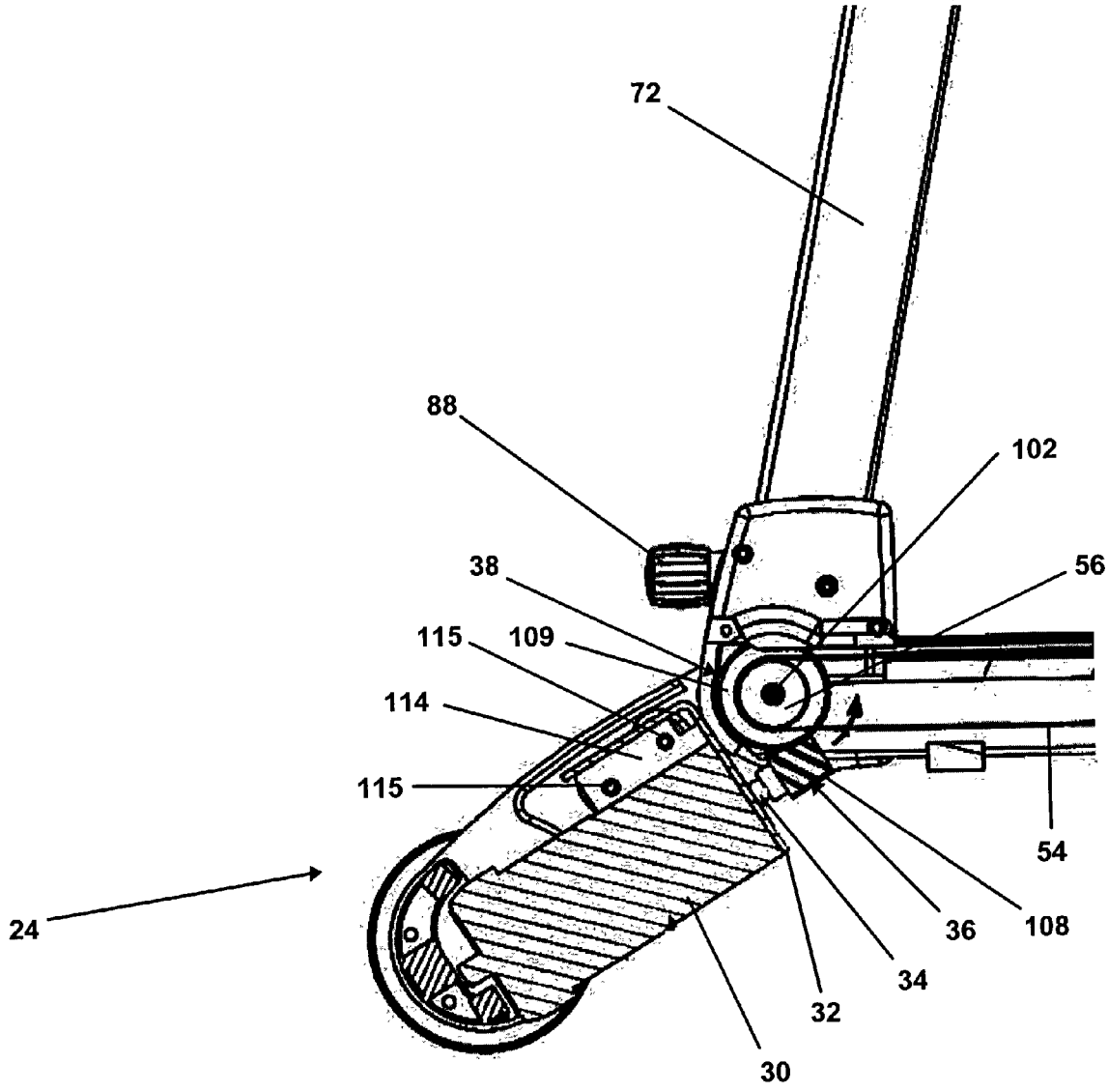
FIG. 2 is a fragmentary cross-sectional view of a cage or subframe of the treadmill shown in FIG. 1.

FIGS. 1 and 2 illustrate an exercise device 20 that is a treadmill 20. The treadmill 20 has a frame 22 movably mounted to a subframe 24 that extends forwardly from the frame 22. The subframe 24 is pivotally mounted to the frame 22 such that it can pivot relative to the frame 24 to increase or decrease the tilt of a deck 26 upon which a user walks or runs. The subframe 24 carries a prime mover 28 that is coupled to the frame 22 such that displacement of the prime mover 28 increases or decreases tilt of the deck 26. In the preferred embodiment shown in FIG. 1, the prime mover 28 comprises a drive 30 that is mounted to the subframe 24 by a bracket 32. Referring specifically to FIG. 2, the tilt drive 30 has a drive shaft 34 to which a gear 36 is attached. The gear 36 engages another gear 38, which is anchored to the treadmill frame 22. Rotation of the shaft 34 of the tilt drive 30 in one direction increases tilt and rotation in the opposite direction decreases tilt.

Where the treadmill 20 is driven, the subframe 24 also carries a treadmill drive 40 that preferably is mounted to the subframe 24 by a bracket 42. In one preferred embodiment, the drive 40 is indirectly coupled to the treadmill by a belt drive arrangement 44.

Figure 3:
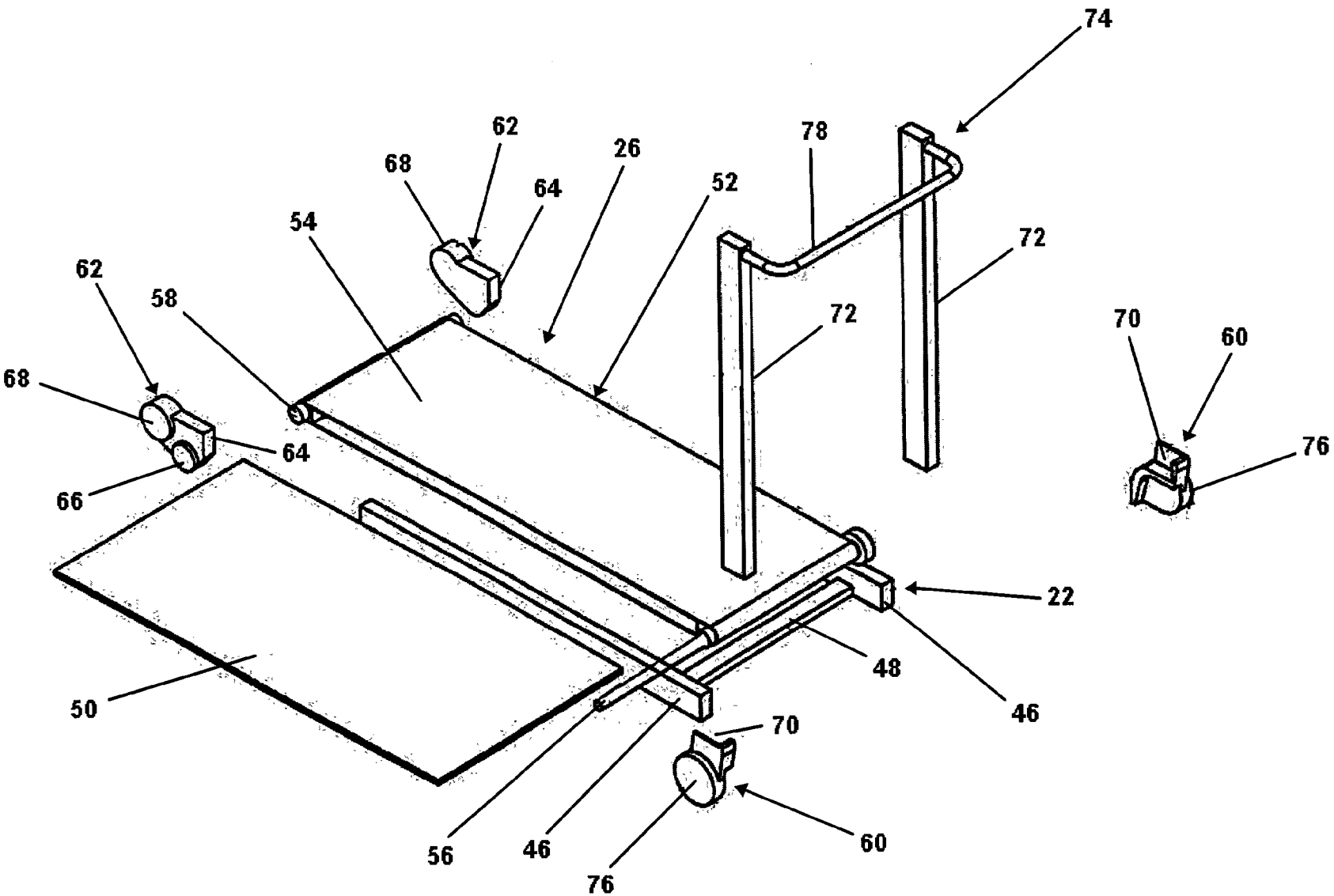
FIG. 3 is an exploded view of the frame and deck of the treadmill shown in FIG. 1.

Referring additionally to FIG. 3, the treadmill frame 22 includes a pair of spaced apart and longitudinally extending frame rails 46 that each extends substantially the length of the treadmill 20. The frame 22 preferably includes at least one transverse brace 48 that extends from rail 46 to the other rail 46. If desired, the frame 22 can be equipped with two or more such braces.

The deck 26 includes a bed 50 that is disposed between or underlies a movable surface 52 upon which a user is supported during operation. If desired, the bed 50 can be resilient such as to help cushion someone running or walking on the movable surface 52. The bed 50 preferably comprises a sheet, such as a sheet of particleboard, a sheet comprised of rubber, a sheet comprised of plastic, or the like. In one preferred embodiment, the movable surface 52 preferably comprises an endless, flexible belt 54.

A pair of spaced apart rollers 56, 58 is disposed within the belt 54 and arranged in a manner so as to urge the ends of the belt 54 apart under tension. One of the rollers 56 is a driven roller that is driven by the treadmill drive 40 and the other one of the rollers 58 is an idler roller. In the preferred treadmill embodiment shown in FIG. 1, the driven roller 56 is located at the front of the treadmill 20 and the idler roller 58 is located at the rear.

The treadmill 20 preferably also includes a front pair of frame rail end caps 60 and a rear pair of end caps 62. The rear pair of end caps 62 each includes a recess 64 for receiving the end of one of the frame rails 46. In the preferred end cap embodiment shown in FIG. 3, the cap 62 preferably also includes an integral rounded footrest 66 and a hub 68 that encompasses one end of the idler roller 58. In one preferred embodiment, the hub 68 of each end cap 62 receives and rotatively supports an end of the roller 58. If desired, the hub 68 can be journalled so as to accommodate rotation of the roller 58.

Figure 4:
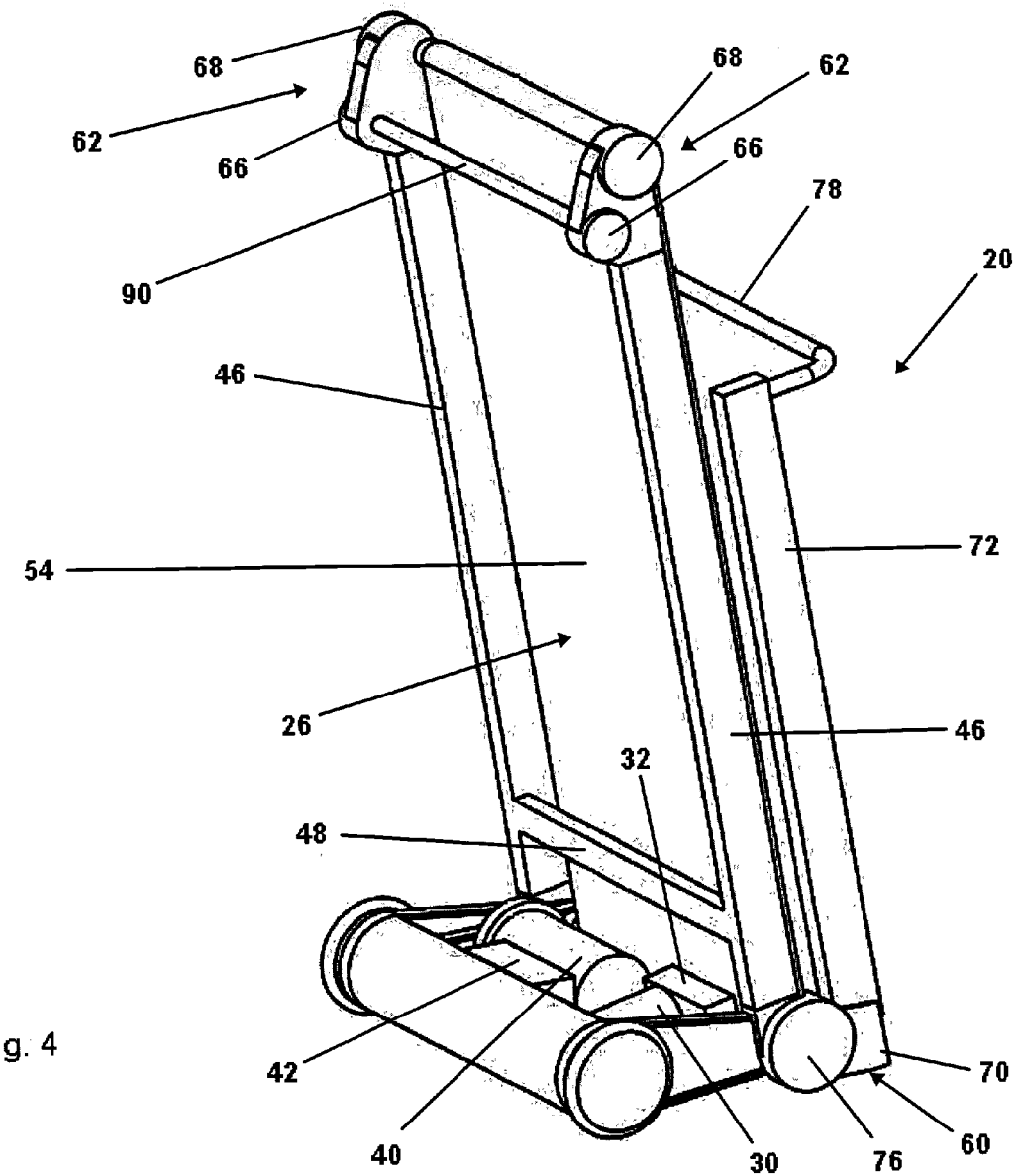
FIG. 4 is a perspective view of the treadmill of FIG. 1, with the cage oriented at an angle relative to the deck so as to enable the treadmill to rest upright on the cage.

Referring additionally to FIG. 4, in one preferred embodiment, there is a brace 90 that extends from one of the end caps 62 to the other one of the end caps 62. Preferably, each rounded footrest 66 comprises a wheel and the brace 90 comprises an axle that extends from one wheel 66 to the other wheel 66.

The front pair of end caps 60 each includes a pocket 70 in which one of a pair of spaced apart handrail stanchions 72 of a handrail assembly 74 is received. Each end cap 60 preferably also includes a hub 76 that encompasses one end of each driven roller 56. In a preferred embodiment, the hub 76 receives and rotatively supports one end of roller 56. If desired, the hub 76 can be journalled so as to accommodate rotation of the roller 56.

Each stanchion 72 preferably is pivotally received in its pocket 70. Preferably, each stanchion 72 is pivotally attached to an end cap 60 and each pocket 70 is constructed and arranged to provide clearance to enable each stanchion 72 to pivot from it generally upright position shown in FIG. 1 approximately 90° to a folded position, such as is shown in FIG. 4, where both stanchions 72 and the handrail 78 are folded generally against the deck 26 or frame rails 46, such as to facilitate shipment or storage. In the preferred embodiment shown in FIG. 4, the handrail 78 is generally U-shaped to enable each stanchion 72 to be disposed outboard and alongside of one of the frame rails 46 to make the entire assembly more compact when folded. To enable the handrail assembly 74 to be folded in this manner, the stanchion-receiving pocket 70 of each end cap 60 positions each stanchion 72 outboard of an adjacent frame rail 46, even when the stanchions 72 are disposed in an upright position.

Figure 5:
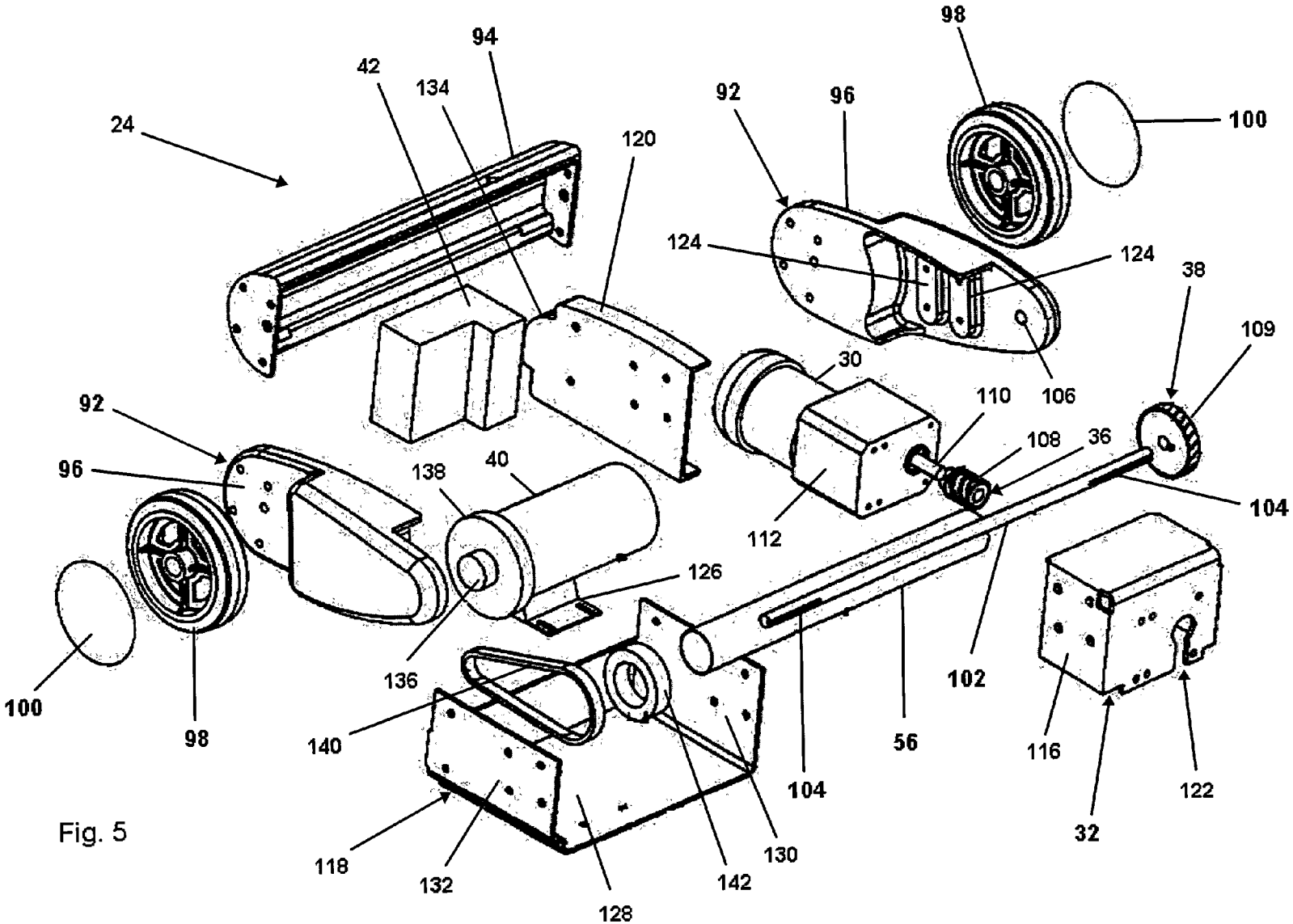
FIG. 5 is an exploded perspective view of the cage and drive of the treadmill shown in FIG. 1.
Figure 6:
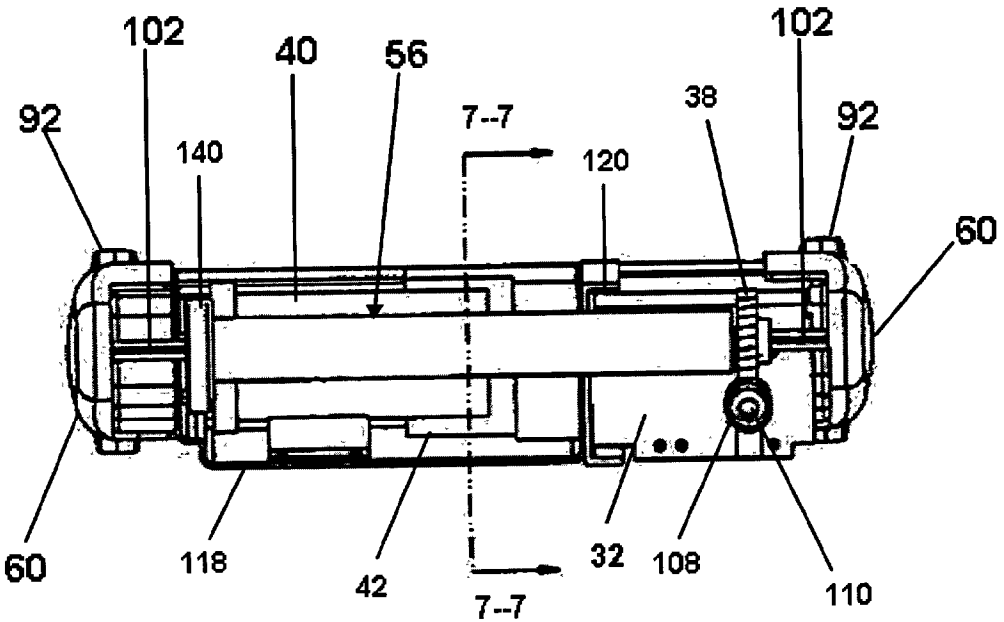
FIG. 6 is an end view of the cage.
Figure 7:
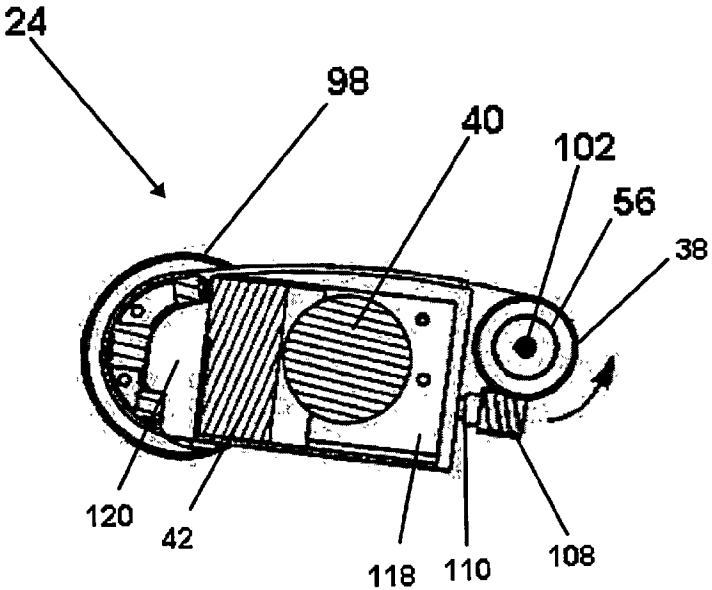
FIG. 7 is a cross-sectional view of the cage shown in FIG. 6 taken along lines 7-7 of FIG. 6.

FIGS. 5-7 illustrate a preferred embodiment of a subframe 24 that extends forwardly from the treadmill frame 22 and pivots to increase or decrease the amount of the incline of the deck 26 to correspondingly increase or decrease the amount of resistance someone walking or running on the treadmill 20 experiences. The subframe 24 comprises a swing cage formed by a pair of spaced apart and longitudinally extending arms 92 and a front kick plate 94 that functions as a cross brace that is disposed between the arms 92. The subframe 24 comprises a drive carriage that receives and supports the treadmill drive 40 in a manner that permits pivoting of the subframe while rotary power is being transmitted by the drive to the belt 54.

The arms 92 of the subframe 24 preferably are pivotally attached to the treadmill frame 22 and fixed to the kick plate 94 by a plurality of fasteners. Each arm 92 includes a forwardly disposed mounting surface 96 to which a rotatable wheel 98 is attached. In a preferred embodiment, there is a wheel cover 100 that overlies each wheel 98. Referring additionally to FIG. 7, the wheels 98 enable the treadmill 20 to be picked up and moved. More specifically, to pick up the treadmill 20, with the swing cage 24 extended, a person can grasp the rear of the treadmill 20 and lift upwardly. This will ensure that the wheels 98 make contact with the ground so that they will rotate to facilitate movement of the treadmill 20.

The swing cage 24, i.e., the subframe or drive carriage, is pivotally attached to the treadmill frame 22 by an anchor rod 102. Referring more specifically to FIGS. 6 and 7, the rod 102 is fixed at or adjacent each end to one of the frame rails 46. In one preferred embodiment, the rod 102 preferably has a key 104 adjacent each end that fixes it to one of the frame rails 46. A portion of each end of the rod 102 sticks outwardly beyond each rail 46 and seats in a hole 106 in each one of the arms 92 (only one of which is shown in FIG. 5) that preferably has a cross sectional shape that is complementary with the cross sectional shape of the rod 102. In the preferred embodiment shown in FIG. 5, the rod 102 has a circular cross section. If desired, each hole 106 can be large enough to accommodate both the rod 102 and its key 104.

Each arm 92 preferably is captured between one of the front-end caps 60 and one of the frame rails 46. In this manner, each arm 92 is pivotally attached to the frame 22 enabling the swing cage 24 to pivot relative to the rest of the treadmill. In one preferred embodiment, each end cap 60 is attached to one of the frame rails 46 by fit, such as a snap fit, a friction fit, or an interference fit. Each end cap 60 can also be attached in other ways. For example, one or more fasteners, such as bolts or the like can be used.

Referring to FIG. 6, the rod 102 is telescopically received through the driven roller 56 and preferably also rotatively supports the roller 56. One end of the rod 102 carries a gear 38 that preferably is a spur gear with generally helical gear teeth that engage the teeth of a gear 36 that is received on an output shaft 110 of a transmission 112 coupled to the tilt drive 30. Gear 36 preferably is a helical gear or worm gear 108. The gear 38 with which it engages preferably is a spur gear 109.

The spur gear 109 is generally fixed to the shaft 102, preferably by being keyed to the anchor rod 102. As a result of the anchor rod 102 being fixed to the treadmill frame 22, and the spur gear 109 being generally fixed to the anchor rod 102, the gear 109 generally does not move relative to the frame 22. Depending on how much torque is applied via the worm gear 108 by the tilt drive 30, the spur gear 109 can rotate a limited amount due to torque-induced deflection or twisting of the shaft 102.

In a preferred embodiment, the tilt drive 30 comprises an electric motor that has an output shaft (not shown) that is coupled to the transmission 112. The transmission 112 preferably is a gear reducer from which the output shaft 110 extends.

Energization of the tilt drive 30, such as by a user manipulating a tilt control of the treadmill 20, causes the output shaft 110 and worm gear 108 to rotate. As the worm gear 108 rotates, it tracks or follows the periphery of the spur gear 109, essentially orbiting the gear 109. Because the spur gear 109 is anchored to the treadmill frame 22, rotation of the worm gear 108 causes the gear 108 to move relative to the gear 109 and the rest of the treadmill 20. As the worm gear 108 moves, it pushes or pulls the entire swing cage 24, thereby raising or lowering the deck 26. As the deck 26 raises or lowers, its incline changes accordingly.

The transmission 112 of the tilt drive 30 is mounted by a tilt drive-mounting bracket 32 to the swing cage 24. The bracket 32 is mounted by a plurality of fasteners 115 along one side 114 (FIG. 2) to one of the swing cage arms 92 and along its other side 116 to a treadmill drive mounting bracket 118 and a support plate 120. Referring to FIGS. 2 and 5, the side 114 of the bracket 32 is attached to a pair of spaced apart mounts 124 integrally formed in an inner surface of arm 60. The bracket 32 has a clearance slot 122 through which shaft 110 extends. The worm gear 108 is disposed beyond the bracket 32 adjacent the driven roller 56. While fasteners are preferably used to secure together all of the brackets 32, 118, the plate 120, and the tilt drive 30, other methods of attachment and other mechanisms can be used.

In the preferred swing cage embodiment shown in FIG. 5, the treadmill drive 40 has a pedestal mount 126 that is mounted to a bottom wall 128 of the treadmill drive-mounting bracket 118. One sidewall 130 is mounted to support plate 120 and wall 116 of the tilt drive-mounting bracket 32. The other sidewall 132 preferably is mounted to the other swing cage arm 92. To help support the treadmill drive 40, there is a spacer, a mounting block or a mounting bracket 42 disposed between it and the front kick plate 94. Such a block 42 can also help dampen vibration. The block 42 can also house treadmill electronics, if desired.

To help impart strength to the entire assembly, the support plate 120 engages the kick plate 94 at or adjacent its free end 134. In the preferred embodiment shown, the free end 134 of the support plate 120 has a curved outer periphery that is complementary with the inner cross sectional periphery of the kick plate 94.

The kick plate 94 comprises a cross brace that is attached at each end to one of the swing cage arms 92. The kick plate 94 preferably is composed of a material that is strong, resilient and preferably which possesses good structural rigidity. In one preferred embodiment the kick plate 94 and swing arms 92 are comprised of a metal such as steel or aluminum.

The treadmill drive 40 preferably is an electric motor that is connected to a control of the treadmill 20 that preferably is located on the console 80, if the treadmill is so equipped. The motor 40 includes an output shaft 136 that carries a pulley or sheave 138 upon which an end of an endless flexible member 140 is received. The endless flexible member 140 preferably comprises a belt. The other end of the endless flexible member 140 is received on another sheave or pulley 142 that is fixed to the driven roller 56. If desired, the pulley 142 can be fixed to the end of the roller 56 or carried by the roller 56.

While the treadmill 20 shown in FIG. 1 has the components disposed in the swing cage 24 exposed, a shroud 150 that overlies at least the front of the cage 24 preferably shields the components in the swing cage. Such a shroud 150 is depicted in FIGS. 2, 6, 7, 9 and 10.

Figure 9:
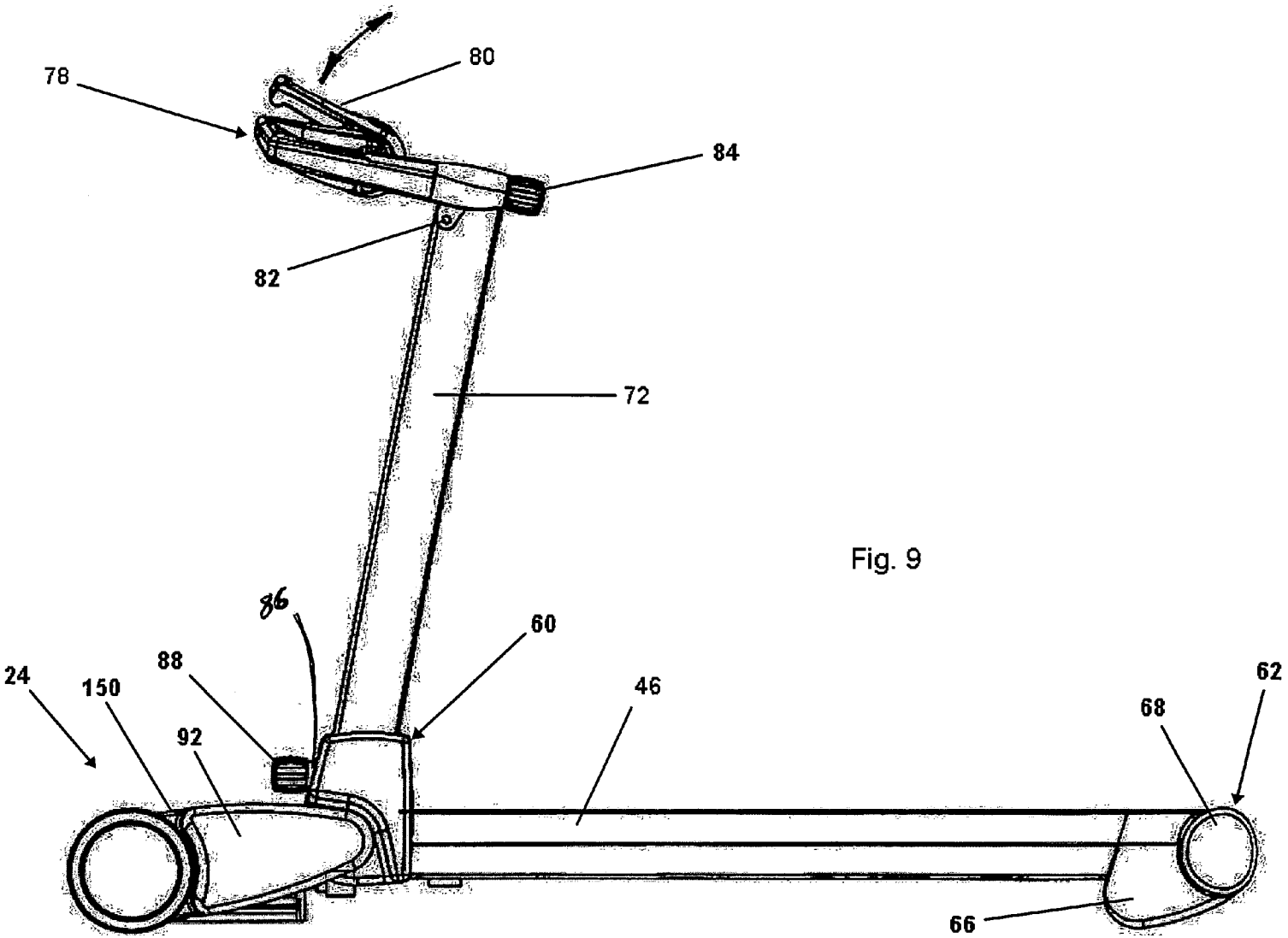
FIG. 9 is a side elevation view of a third preferred embodiment of a treadmill.
Figure 10:
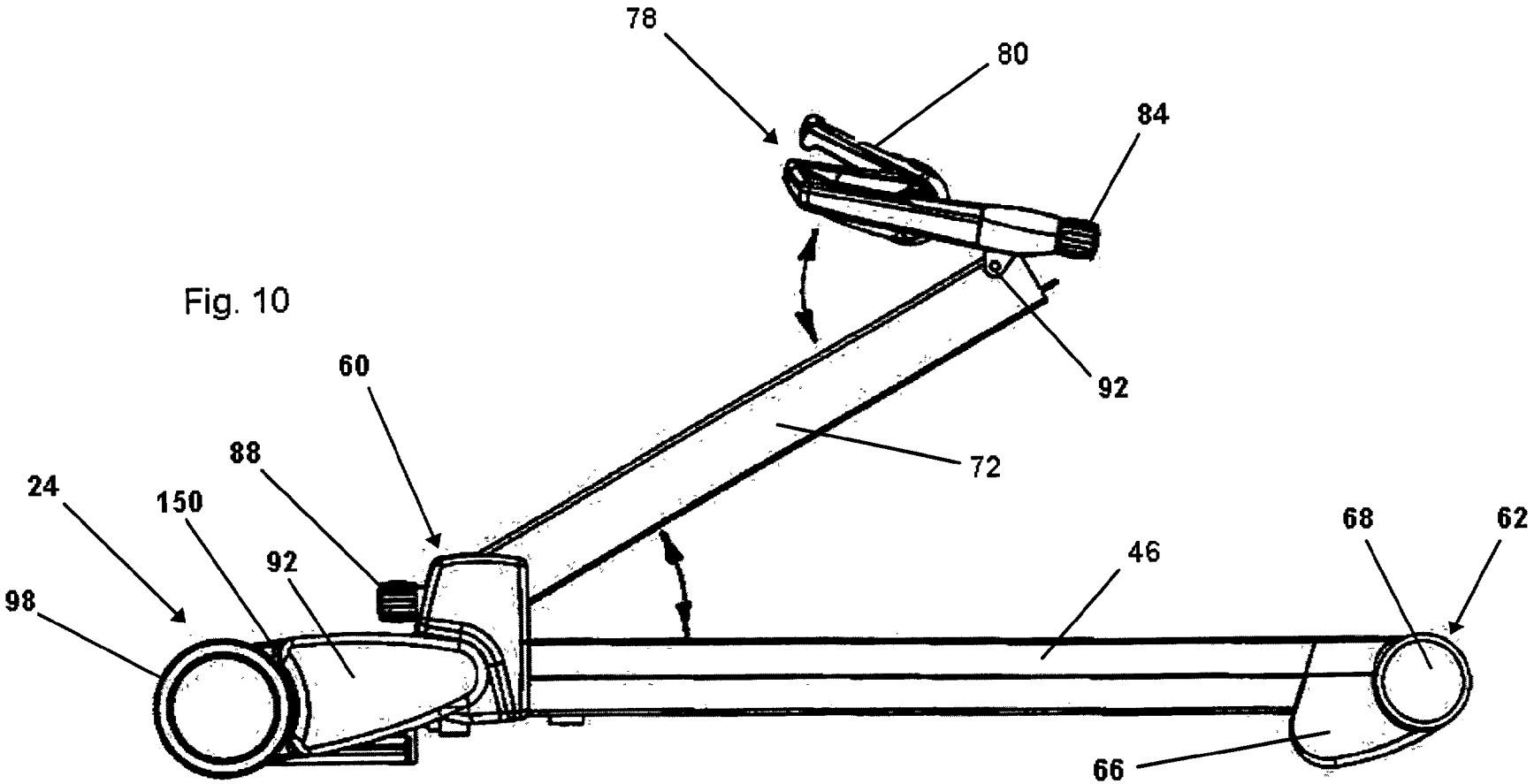
FIG. 10 is a side elevation view of the third preferred treadmill embodiment depicting its console and handrail assembly in a semi-folded condition.

In one preferred embodiment, such as is depicted in FIGS. 9 and 10, the handrail assembly 74 is comprised of a pair of stanchions 72 that supports a generally horizontal handrail 78. The handrail 78 can accommodate a console 80 that preferably includes controls and one or more displays. Where equipped with controls, the console 80 preferably is also equipped with at least one control that controls or regulates the operation of the tilt drive 30. The console 80 preferably has a control that enables the tilt of the treadmill 20 to be selectively increased or decreased.

In the preferred console embodiment shown in FIGS. 9 and 10, the console 80 preferably can be folded such that it is disposed against or generally flush with the handrail 78 and/or the stanchions 72, such as in the manner depicted in FIG. 9. Such a folding feature is advantageous because it enables the console 80 and handrail assembly 74 to be folded nearly flat against the deck 26 for storage.

In the preferred console embodiment shown in FIGS. 9 and 10, the console 80 is attached by a pivot 82 to the handrail 78 and/or its stanchions 72 that enables it to be folded. The console 80 includes a knob 84 that is manipulated to rotate the console 80 or permit the console 80 to be rotated about the pivot 82 to fold or unfold the console 80. Likewise, the stanchions 72 are connected to the frame by a pivot 86 and a knob 88, which are manipulated to facilitate folding or unfolding of the handrail assembly 74 toward the frame rails 46, such as in the manner shown in FIG. 10.

In one preferred embodiment, the console 80 is frictionally retained in place and manipulation of the console knob 84 displaces the console 80 causing it to rotate about pivot 82. The knob 84 preferably is rotated to displace the console. In another preferred embodiment, the console 80 is retained in place by one or more detents that engage stanchions 72. Manipulation of the knob 84, such as by rotation in one direction, sufficiently disengages the console 80 such that it can be pivoted. Further manipulation, such as by rotation in another direction, engages the console 80, retaining it in its new position. In a still further preferred embodiment, the knob 84 is pulled to release the console 80, allowing it to pivot, such as when being folded. When the console 80 is returned to its generally horizontal operating position, engagement can be automatic or by pulling and releasing the knob 84. Other methods and arrangements can be used. Like mechanisms and methods of folding the stanchions 72 and/or the handrail assembly 74 preferably are also used.

FIG. 1 illustrates one preferred drive arrangement. Drive belt 140 is connected to a pulley/sheave 144 to a dual pulley/sheave 146. A second driven belt 148 extends between a second pulley/sheave (not shown in FIG. 1) and the driven roller pulley/sheave 142. The dual pulley/sheave 146 preferably is mounted to one of the swing arms 92. For example, in one preferred embodiment, the dual pulley/sheave 146 is mounted on a stub shaft (not shown) that is attached to arm 92.

Figure 8:
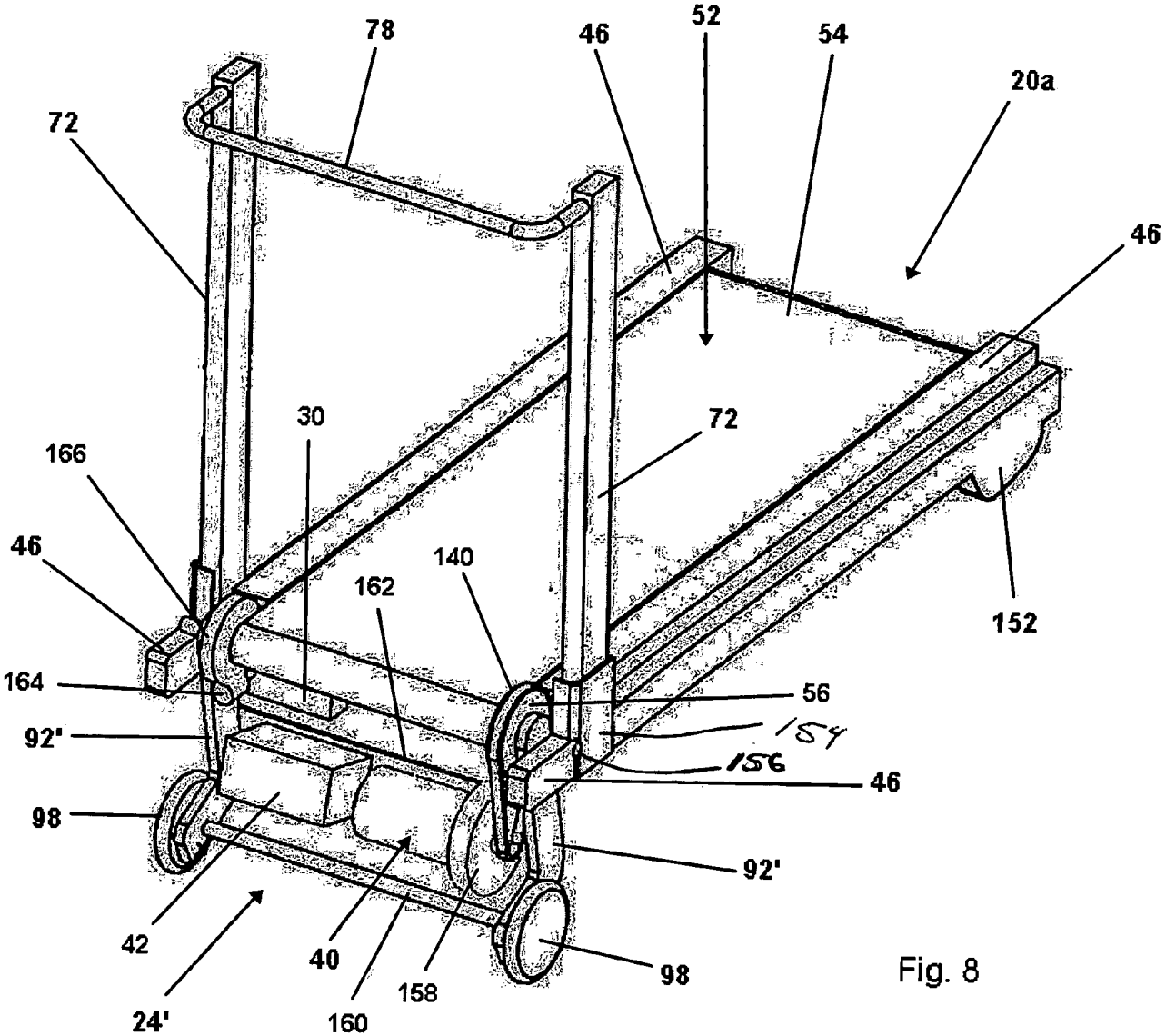
FIG. 8 is a perspective view of a second preferred embodiment of a treadmill having a cage with a treadmill belt drive carried by the cage.

FIG. 8 illustrates another preferred treadmill embodiment that is similar to the treadmill shown in FIGS. 1-7. The treadmill 20*a* has a pair of frame rails 46 that each has an integrally formed foot 152. Each frame rail 46 includes a handrail stanchion holder 154. In the preferred embodiment shown in FIG. 8, each holder 154 is attached by a pivot 156 that enables the handrails 72 to be folded clockwise toward the deck 26. The treadmill drive 40 has a flywheel 158 that is disposed between it and drive belt 140. The wheels 98 are mounted to the swing cage arms 92' and are attached to each other by an axle 160. Both the treadmill electronics 42 and the drive 40 preferably are mounted to a plate 162 that extends from one swing arm 92' to the other swing arm 92'.

The tilt drive 30 is mounted to the treadmill frame 22. Preferably the drive 30 is mounted to one of the frame rails 46. The worm gear 108 (not shown) is received in a bore in an arm 164 that is fixed to one of the swing arms 92' for movement in unison therewith. The bore is preferably internally threaded with threads that are complementary to the threads of the worm gear 108. In another preferred embodiment, the gear 108 comprises a screw that is received in a nut that is carried by or integral with arm 164. A ballscrew assembly can be used. In its preferred embodiment, the arm 164 is part of a disk 166 that is attached to or integral with one of the swing arms 92'.

In one preferred embodiment, the gear 108 comprises a screw of a ball screw assembly and the arm 164 comprises a ball nut. In operation, rotation of gear 108 displaces the arm 164 relative to the treadmill frame 22, which, in turn, moves the arms 92' relative to the treadmill 20'. As a result, rotation of gear 108 extends or retracts the swing cage 24, which thereby increases or decreases the angle of inclination of the treadmill 20'.

FIGS. 11-16 illustrates a currently preferred embodiment of a treadmill 20*b* constructed in accordance with the invention. The treadmill 20*b* has a frame 200 that includes a pair of frame rails 202 and 204 that carry a pair of rollers 206 and 208 journalled for rotation therebetween. The rollers 206 and 208 carry a treadmill belt 210 in a manner such that the belt can move in a front-to-back direction from adjacent a front of the treadmill 20*b* toward a back of the treadmill 20*b*. A drive carriage 212 carries a treadmill drive 214 that is coupled by an endless flexible member 216, preferably a belt, to one of the rollers 206 to move the treadmill belt 210. The drive carriage 212 is captured between a top cover 218 and a bottom cover 220 that preferably is constructed of a protective material, such as plastic or the like.

Figure 11:
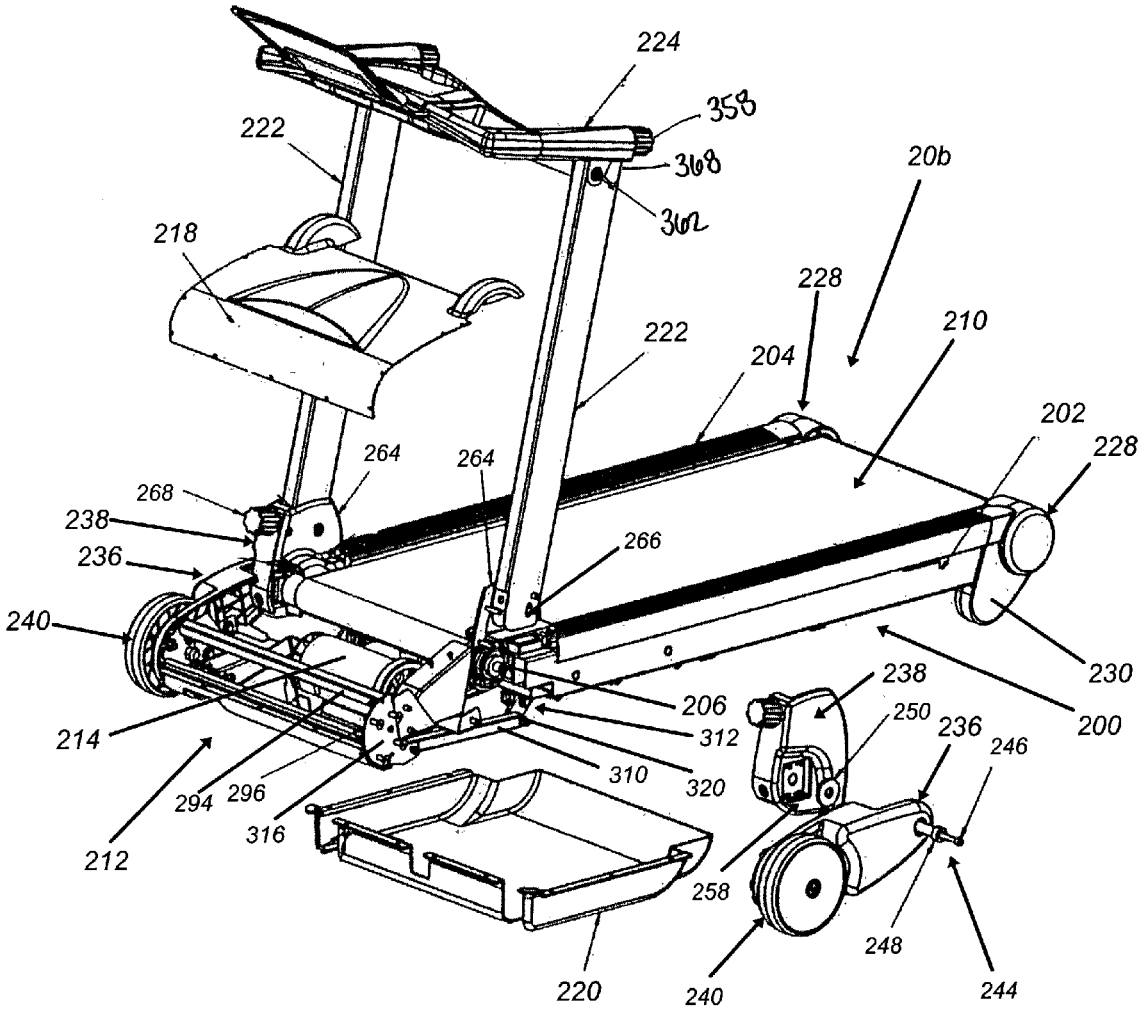
FIG. 11 is a fourth preferred treadmill embodiment.

Each frame rail 202 and 204 pivotally carries a stanchion 222 that is shown in FIG. 11 disposed in a generally upright operating position. Each stanchion 222 can be pivoted toward the frame rails 202 and 204 and the treadmill belt 210, such as when moving it toward a folded or storage position. A handrail assembly 224 extends transversely between the stanchions 222 and carries a console 226. The handrail assembly 224 is pivotally connected to each stanchion 222 in a manner that permits it to be pivoted between a generally horizontal operating position, such as the console position depicted in FIG. 11, and a folded or storage position where it is disposed adjacent or against the stanchions 222.

Figure 13:
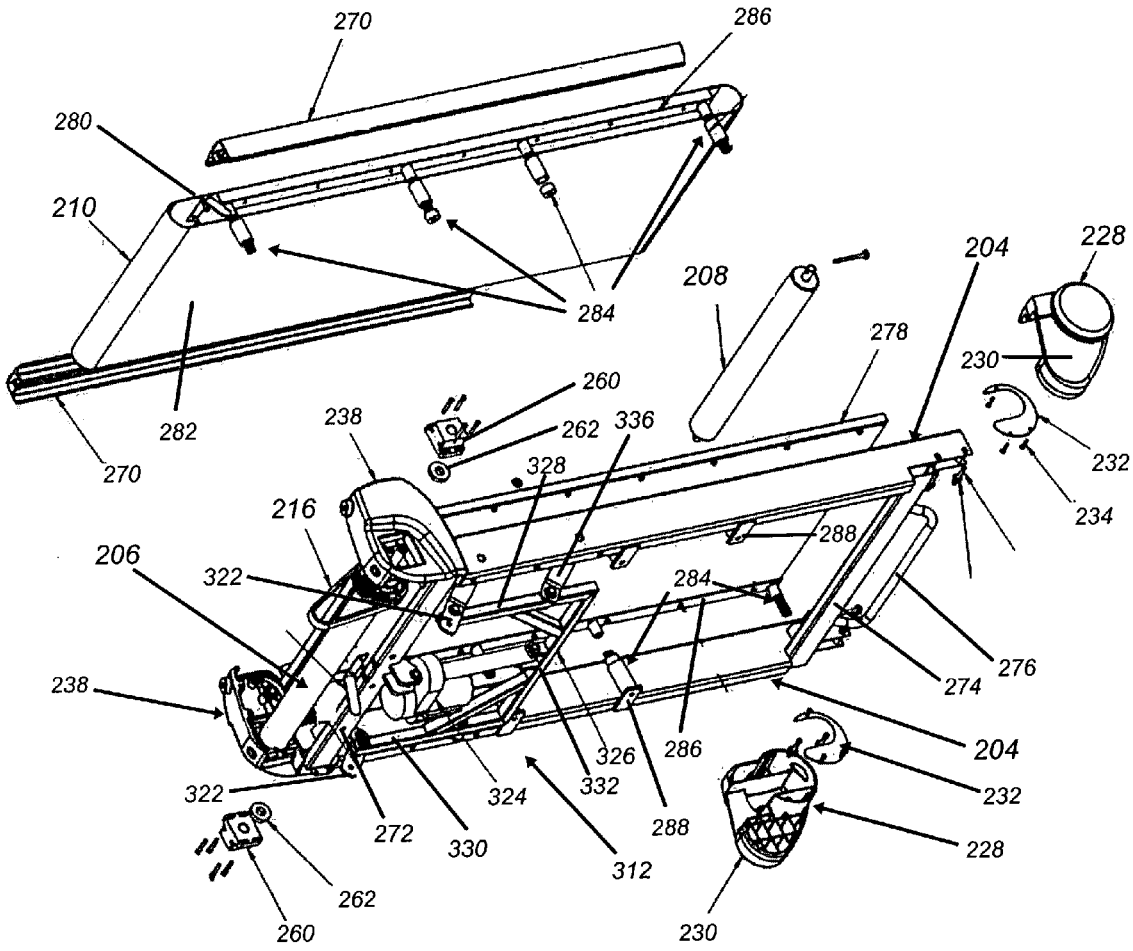
FIG. 13 is an exploded perspective view of the deck and frame of the fourth treadmill embodiment.

The rear of the treadmill 20*b* rests on a pair of frame rail end caps 228 that each has an integral foot 230 projecting therefrom that bears against the ground to space the bottom of the treadmill off the ground. Preferably, each end cap 228 is of one piece and unitary construction. Each foot 230 preferably comprises a support that is inclined toward the front of the treadmill 20*b* so as to prevent someone walking in the vicinity of the treadmill from tripping on it. Referring additionally to FIG. 13, a cover 232 is disposed between each end cap 228 and the frame rail to which the end cap is mounted. A plurality of fasteners 234 preferably attaches each end cap 228 to its respective frame rail.

The front of the treadmill 20*b* rests upon a pair of spaced apart swing arms 236 of the drive carriage 212 that are each pivotally anchored to the frame 200. Each arm 236 preferably is carried by a front frame rail end cap 238 that is mounted to one of the frame rails. In the preferred embodiment shown in FIG. 11, each arm 236 also has a rotatable wheel 240 that is received in a recess 242 in the arm. The recess 242 preferably provides clearance for the wheel 240 such that an outer surface of the wheel 240 preferably is recessed or substantially flush with an exposed outer surface of the arm 236.

Figure 12:
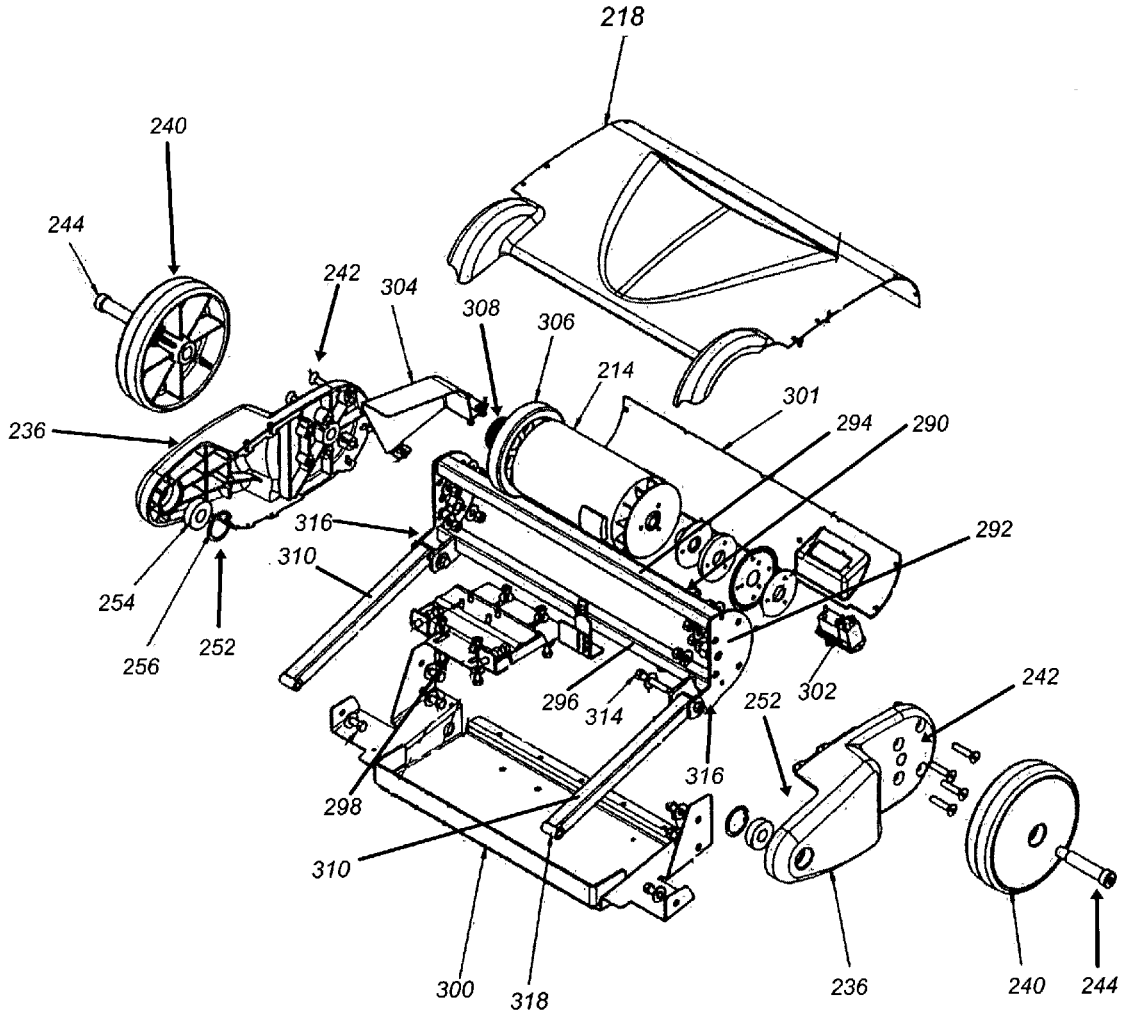
FIG. 12 is an exploded perspective view of a preferred embodiment of a subframe or cage and drive assembly.

Each swing arm 236 attaches to one of the front frame rail end caps 238 by a pivot assembly 244. The pivot assembly 244 includes a bolt 246 that is received inside a shoulder bolt sleeve 248. The pivot assembly 244 extends through a bore in one end of the arm 236 and engages one of the front frame rail end caps 238. Preferably, the pivot assembly 244 threadably engages one of the front frame rail end caps 238. In the preferred embodiment shown, the bolt 246 is threadably received in a bore in part of one of the frame rail end caps 238. A spacer 250, such as a washer or the like, preferably is disposed between each arm 236 and the end cap 238 to which it is pivotally mounted. As is shown in FIG. 12, an interior surface of each arm 236 has a pocket 252 in which a bearing 254 retained by a snap ring 256 is disposed. The bearing 254 and spacer 250 facilitate rotation of each arm about its pivot assembly. Each front frame rail end cap 238 has a pocket 258 for receiving one end of an arm 236 such that the outer surface of the arm 236 can be slightly recessed or substantially flush with an exposed outer surface of part of the end cap 238 located adjacent the arm 236.

Referring once again to FIG. 13, each front rail end cap 238 has a roller insert 260 with a bore therein, in which an axle end of the treadmill driven roller 206 is received. An insert 260 is received in a pocket or window in each end cap 238. A spacer 262 preferably is disposed between the insert 260 and the end cap 238 to which the insert 260 is mounted. In the preferred embodiment shown in FIG. 13, each insert 260 is attached to one of the end caps 238 by a plurality of fasteners. The spacer 262 is received over the end of the roller axle end that is received in the insert 260.

Each stanchion 222 is pivotally captured between one of the end caps 238 and an upright mount 264 that is anchored to the treadmill frame 200. Each mount 264 has an outwardly extending pivot pin 266 that is received in a bore in one of the stanchions 222 that is located adjacent an end of the stanchion. Each end cap 238 is equipped with a knob 268 that can be turned to engage one of the stanchions 222. Although not shown in FIG. 11, each knob 268 has a threaded stem that is threadably received in a threaded bore in a stanchion. When threadably engaged, the stanchion 222 remains in an upright or operating position. When both knobs are disengaged, the stanchions can be pivoted in unison toward the frame rails 202 and 204 and the treadmill belt 210.

Referring to FIG. 13, the treadmill frame 200 is comprised of a pair of spaced apart and generally parallel frame rails 202 and 204 the each carries a cover 270 with a flange that overlies a portion of the treadmill belt 210. The frame 200 includes a plurality of spaced apart and transversely extending cross braces 272 and 274 that interconnect the frame rails. The front cross brace 272 is disposed underneath and adjacent the front driven roller 206 and the rear cross brace 274 is disposed underneath and adjacent the rear idler roller 208. A handle 276 preferably that extends outwardly from the rear cross brace 274 toward the rear of the treadmill for being grasped by a user to lift and maneuver the treadmill. Where the treadmill is configured to be stored with its deck in an upright position, the handle 276 can be used to maneuver and lift the deck upwardly into such a storage position.

To help support the treadmill belt 210, there is a support bed 278 disposed between a top surface 280 of the treadmill belt and a bottom surface 282 of the belt. The bed 278 preferably is a sheet of material that can be wood, plastic, rubber, a composite, or another material that is carried by the frame rails 202 and 204 and that also minimizes friction between it and the belt 210. One preferred bed comprises SLIKDEK, which is a slider bed for treadmills made or marketed by D and P Products, Inc., 1923 Merrill Creek Parkway, of Everett, Wash. 98203.

The bed 278 is attached to the treadmill frame 200 by a plurality of pairs of springs 284 that are spaced apart along each longitudinally extending side of the bed. A longitudinally extending channel 286 is attached along each side of the bed 278. Each spring 284 has one end mounted to one of the channels 286 and its other end mounted to a platform 288 that extends outwardly from each one of the frame rails. Together, the springs 284 and bed 278 help cushion a user of the treadmill from the impact generated by each step taken by the user during use of the treadmill.

Referring once again to FIG. 12, the drive carriage 212 carries the drive 214 such that it is spaced from the treadmill belt 210, thereby permitting a walk-through treadmill arrangement to be achieved. As a result, a maximum amount of treadmill belt surface area is advantageously exposed and available to a user to walk on.

The drive 214 is received in a cage 290 of the drive carriage. The cage 290 includes a pair of fore-aft extending swing arm mounting side plates 292 that are spaced apart by a plurality of transversely extending braces 294 and 296. Each end of each brace 294 and 296 is fixed to one of the mounting plates 292, such as preferably by welding. As is shown in FIG. 12, each swing arm 236 is attached to one of the side plates 292 by a plurality of fasteners that preferably are bolts. The drive 214 is attached to an adjustment plate 298 that is, in turn, attached by fasteners to a drive-mounting pan 300 that is fixed to both side plates 292. The adjustment plate 298 advantageously permits the position of the drive 214 to be adjusted relative to the driven roller 204 so as to ensure the connecting belt 216 is properly positioned and aligned. A shroud 301 attaches to the cage 290 and is positioned exteriorly of the drive 214 so as to shield the drive. In the preferred embodiment shown in FIG. 12, the shroud 300 has a cutout for receiving a power switch 302, such as for supplying electrical power to the drive. A belt guard 304 is also attached to the cage 290 and positioned adjacent a flywheel 306 of the drive 214 so as to overlie the drive pulley 308 and part of the belt 216.

As previously mentioned, each swing arm 236 has one end pivotally carried by the treadmill frame 200 and is also attached to the drive carriage 212. In the preferred treadmill embodiment depicted in FIGS. 11-16, each swing arm 236 is pivotally mounted adjacent one end to one of the front frame rail end caps 238 and fixed adjacent its other end to one of the side plates 292 of the cage 290.

The drive carriage 212 also includes a pair of spaced apart connecting links 310 that pivotally connect the carriage 212 to a treadmill incline drive assembly 312 that is disposed underneath the top surface of the treadmill belt 210. As is shown in FIG. 12, one end of each link 310 is attached by a pivot pin 314 to a clevis 316 that is formed by a first tab extending from one of the side plates 292 of the cage 290 and a second tab that extends outwardly from the lowermost transverse brace 296 of the cage. The pin 314 extends through bores in both tabs and the link. The other end of each connecting link 310 is pivotally attached to the treadmill incline drive assembly 312. In the preferred link embodiment shown in FIG. 12, the other end of each link 310 has a tube or journal 318 that accommodates a pivot pin 320 (FIG. 11) that extends through it and a part of the incline drive assembly 312.

Figure 14:
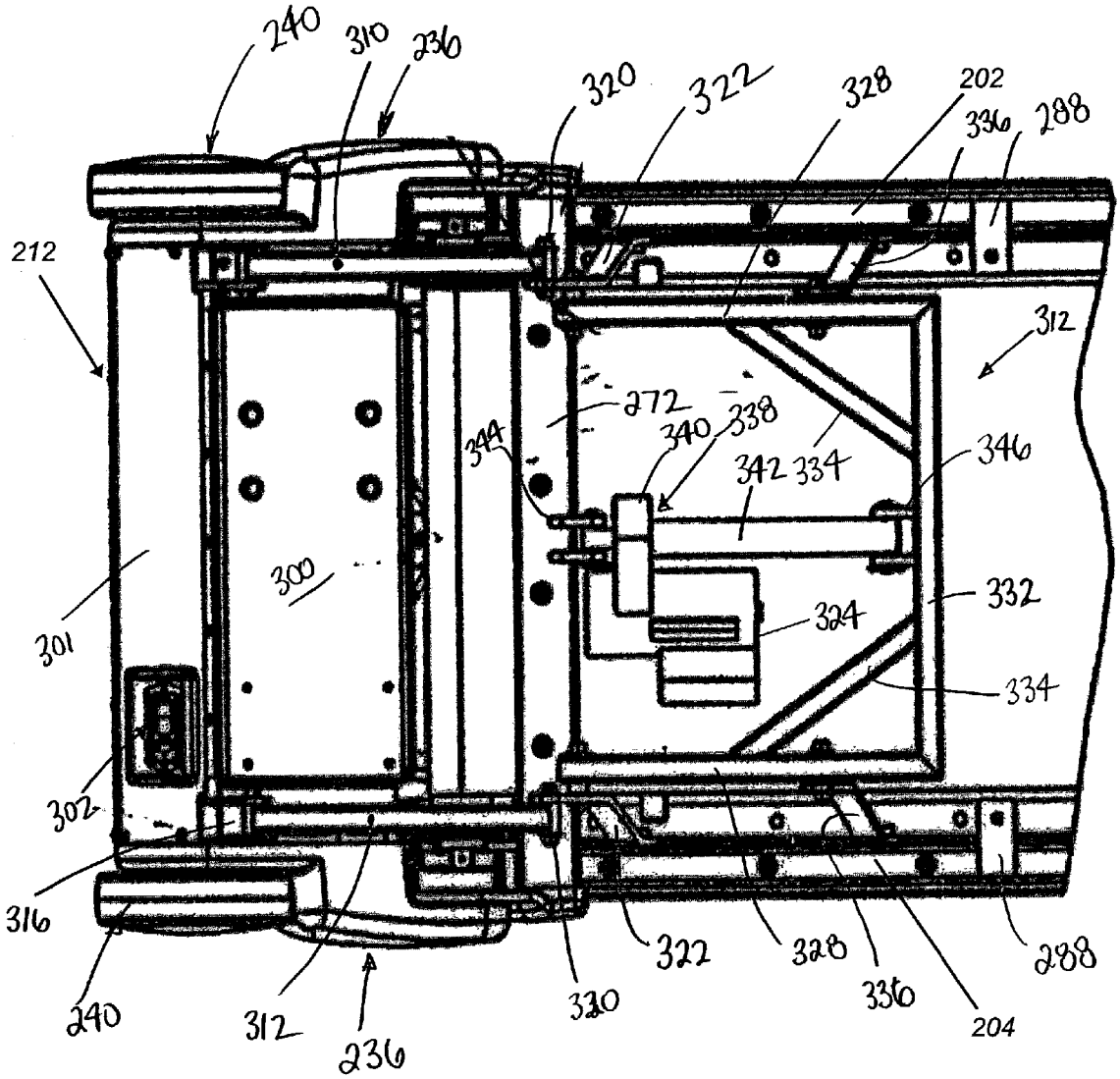
FIG. 14 is a fragmentary bottom view of a portion of the fourth treadmill embodiment depicting a preferred lift or incline arrangement.

Referring to FIGS. 11, 13 and 14, each connecting link 310 is pivotally connected by a pivot pin 320 to an arm 322 of the incline drive assembly 312, which is movably mounted to the treadmill frame 200. The incline drive assembly 312 is driven by an incline drive 324 that is disposed underneath the treadmill belt and bed that displaces part of the incline drive assembly 312 along a fore-aft or aft-fore direction to change the incline of the treadmill deck by displacing the drive carriage 212 relative to the treadmill frame 200.

In the preferred incline assembly shown in FIGS. 11, 13 and 14, the incline drive assembly 312 comprises a four bar linkage arrangement that pivotally attaches a swing frame 326 to the treadmill frame rails. The swing frame 326 has a pair of fore-aft extending rails 328 and 330 with one of the swing frame rails disposed alongside one of the frame rails and the other one of the swing frame rails disposed alongside the other one of the frame rails. The swing frame includes a transversely extending cross brace 332 that interconnects both swing frame rails. To reinforce and stiffen the swing frame, an angled strut 334 interconnects each swing frame rail and the cross brace. The four bar linkage arrangement comprises two pairs of spaced apart arms with one pair of arms 322 and 336 pivotally linking one swing frame rail to one of the treadmill frame rails and the other pair of arms 322 and 336 pivotally linking the other swing frame rail to the other one of the treadmill frame rails.

The incline drive preferably comprises a linear actuator 338 that is grounded or anchored to the treadmill frame that is used to displace the swing frame 326 in a fore-aft or aft-fore direction to change the incline of the treadmill deck. In one preferred embodiment, the incline drive comprises an electric motor 324 with its output shaft coupled to a ball screw 340 that attaches to a rod 342 that is pivotally linked to the swing frame. In the preferred embodiment depicted in FIGS. 11, 13 and 14, the incline drive is pivotally linked to the front treadmill frame cross brace 272 and its rod 342 is pivotally attached to the cross brace 332 of the swing frame. Referring to FIG. 14, the ball screw is pivotally attached to a clevis 344 that extends from the treadmill frame cross brace 272 and the rod 342 is pivotally attached to another clevis 346 that is attached to the cross brace of the swing arm frame. During operation, rotation of the output shaft of the incline drive motor displaces the rod that extends from the ball screw to correspondingly displace the swing frame. Displacement of the swing frame, in turn, displaces the drive carriage by either urging it toward or away from the incline drive assembly. As the drive carriage is displaced, it pivots about its point of attachment to the treadmill frame causing the incline of the treadmill deck to change.

Figure 15:
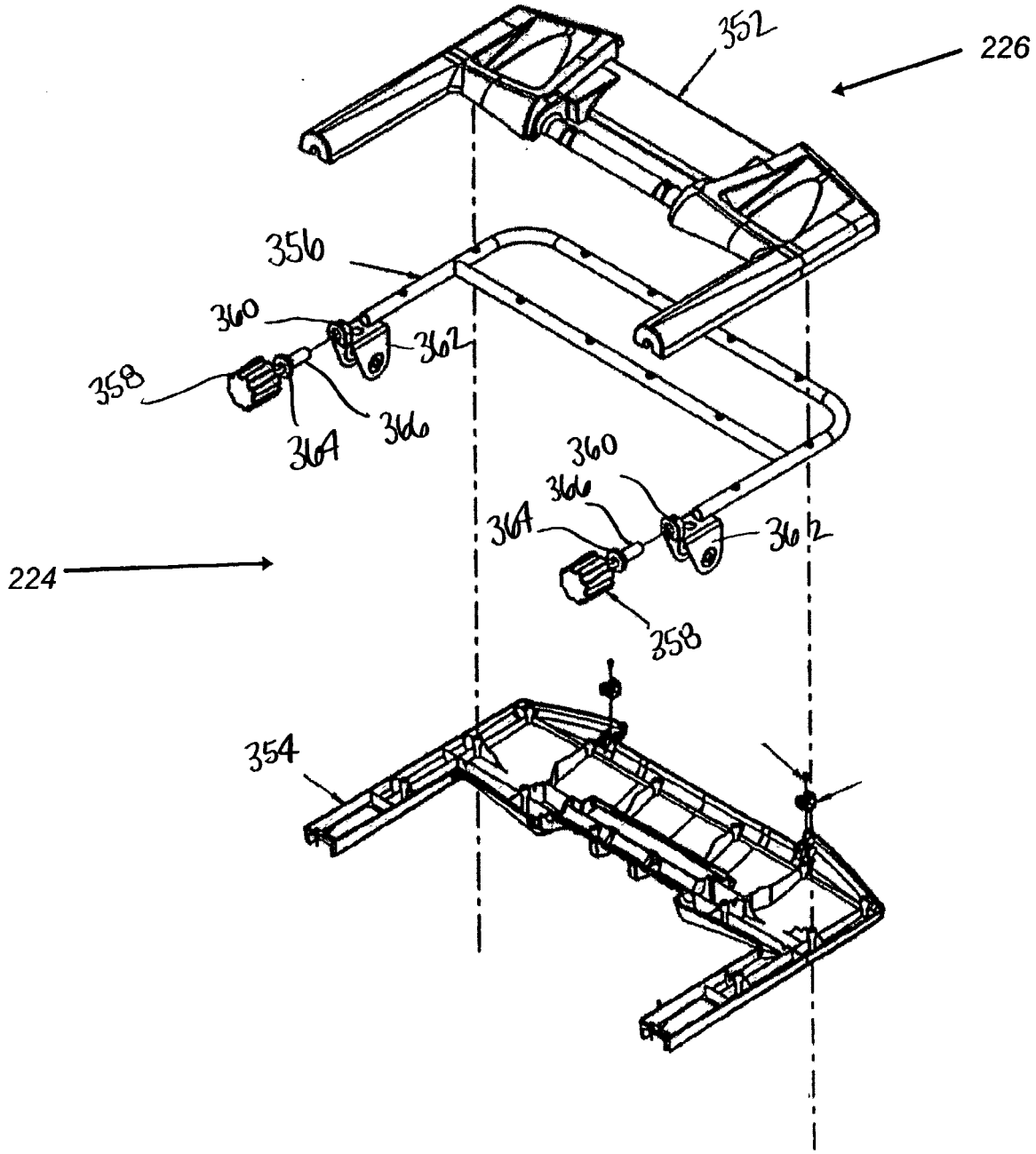
FIG. 15 is an exploded perspective view of a handle bar and console assembly.
Figure 16:
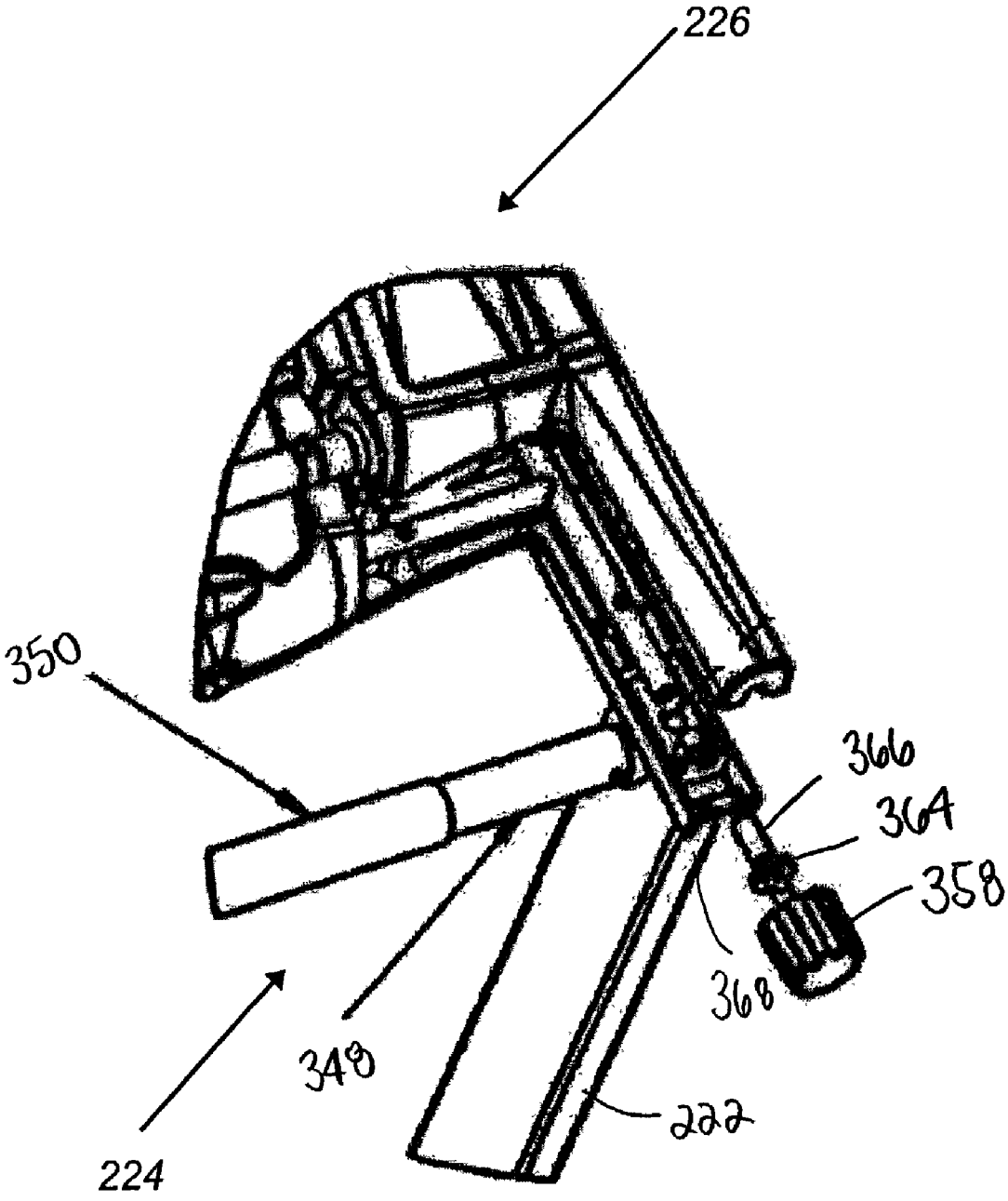
FIG. 16 is an enlarged fragmentary perspective view of a portion of the handle bar and console assembly shown in FIG. 15.

FIGS. 15 and 16 depict various details of a currently preferred embodiment of a handrail assembly 224 and console 226 carried by the handrail assembly. The handrail assembly can include a grab handle 348 (FIG. 16) that preferably is covered by a sleeve 350 made of foam or some other cushioning material. The grab handle extends from one stanchion to the other stanchion and can serve as a support for the console. Additionally, the grab handle can serve as a fulcrum about which the console can pivot when being folded toward the stanchions 222 toward a storage or shipping position.

The console 226 includes an upper console housing 352 and a lower console housing 354 that sandwich therebetween a generally U-shaped console frame 356 that preferably is of tubular construction. The console includes a pair of handgrips that can be grasped during treadmill operation, such as to steady a user who has lost their balance.

Adjacent each handgrip is a knob 358 that can be rotated in one direction to permit the console 226 to pivot relative to the stanchions 222. Each knob 358 is received in a threaded tang 360 of a pivot 362 that pivotally attaches to one of the stanchions. Each pivot preferably has one end in communication with an end of the console frame. When rotated in one direction, a flange 364 that extends radially from a threaded stem 366 of the knob 358 abuts against a portion 368 (FIG. 16) of the stanchion 222 locking the console in a generally horizontal operating position. When the knob is rotated in an opposite direction, the flange 364 moves away from the stanchion thereby disengaging from the stanchion, permitting the flange to clear the stanchion when the console is pivoted. As a result of the flange clearing the stanchion, the console can then be pivoted toward the stanchion toward a storage or shipping position.

Figure 17:
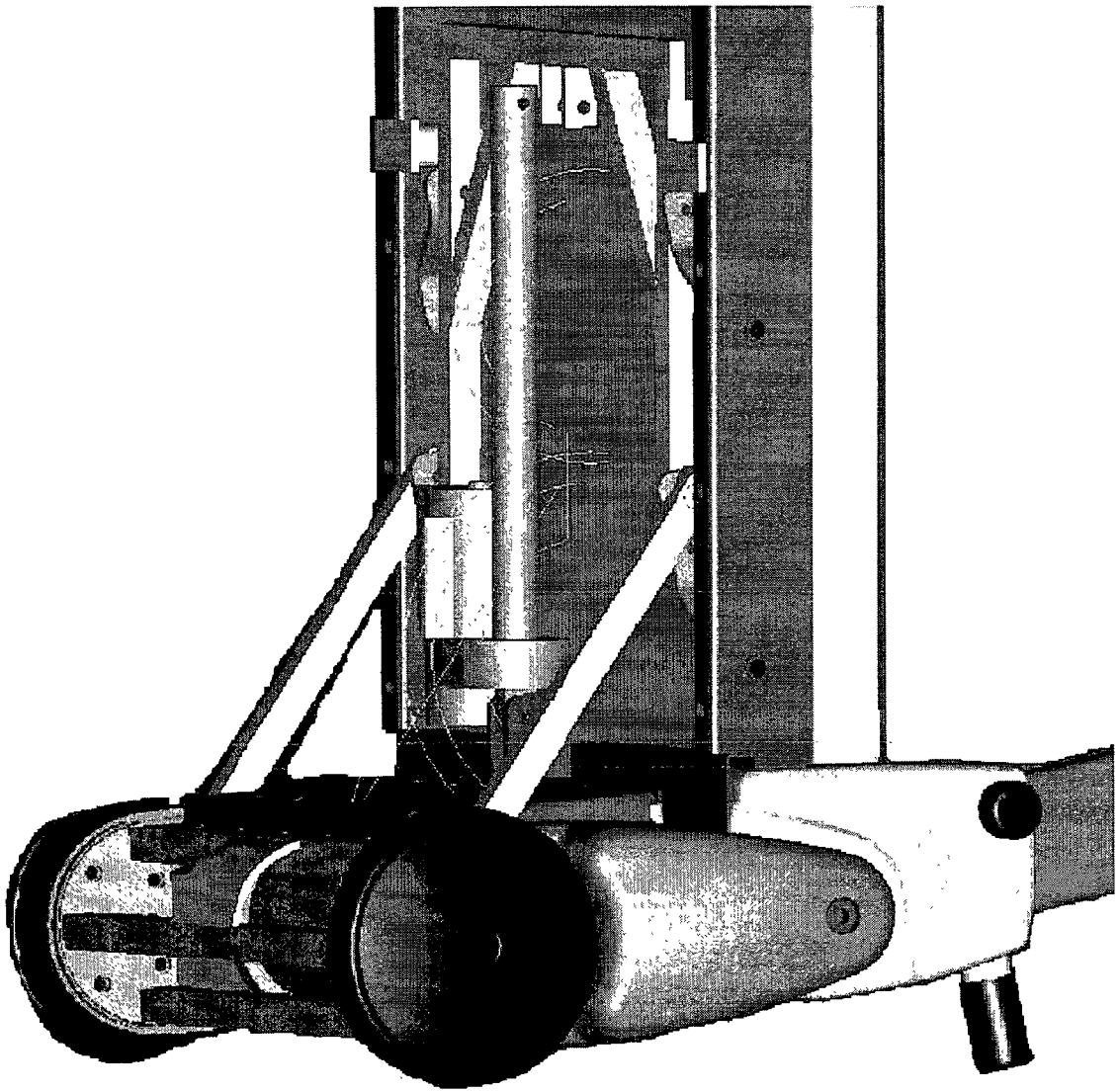
FIG. 17 is a bottom fragmentary perspective view of the underside of the treadmill depicting a preferred embodiment of an incline linkage assembly for pivoting the cage or subframe relative to the deck.
Figure 18:
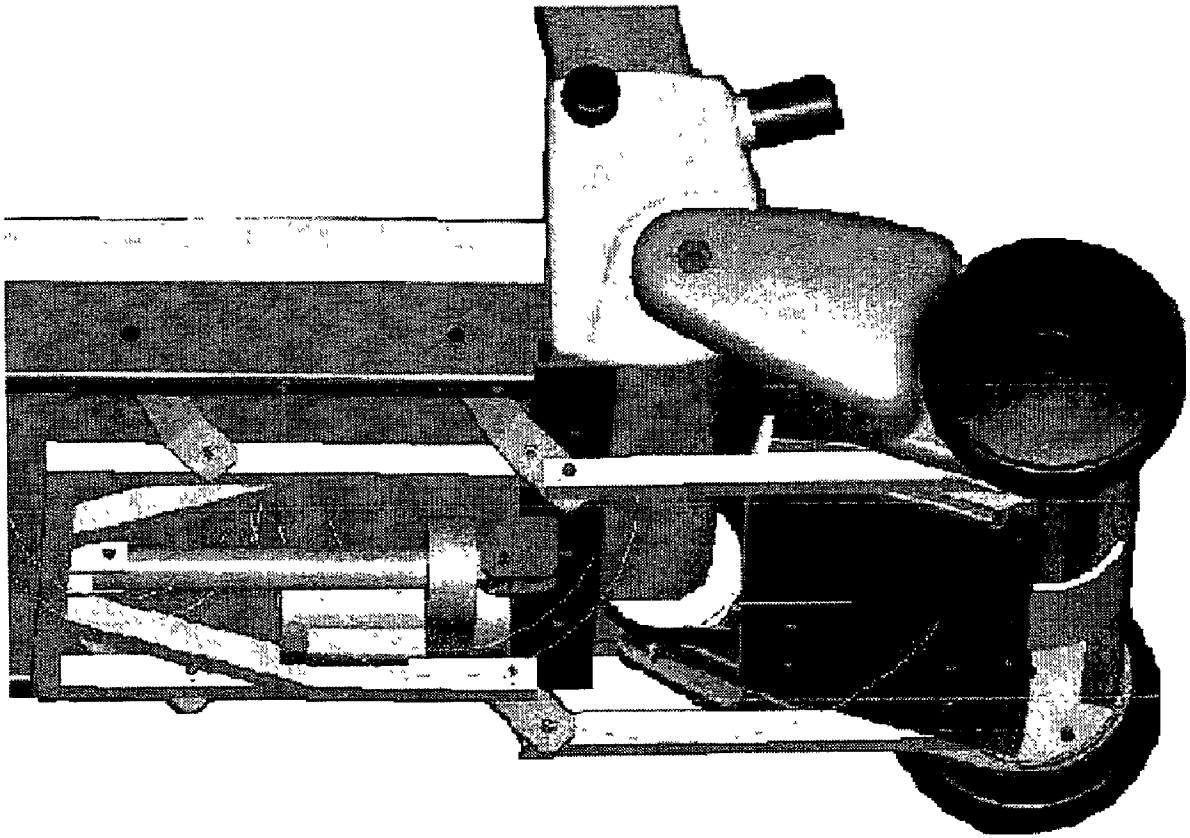
FIG. 18 is a bottom fragmentary perspective view of the underside of the treadmill with the cage forwardly extended.
Figure 19:
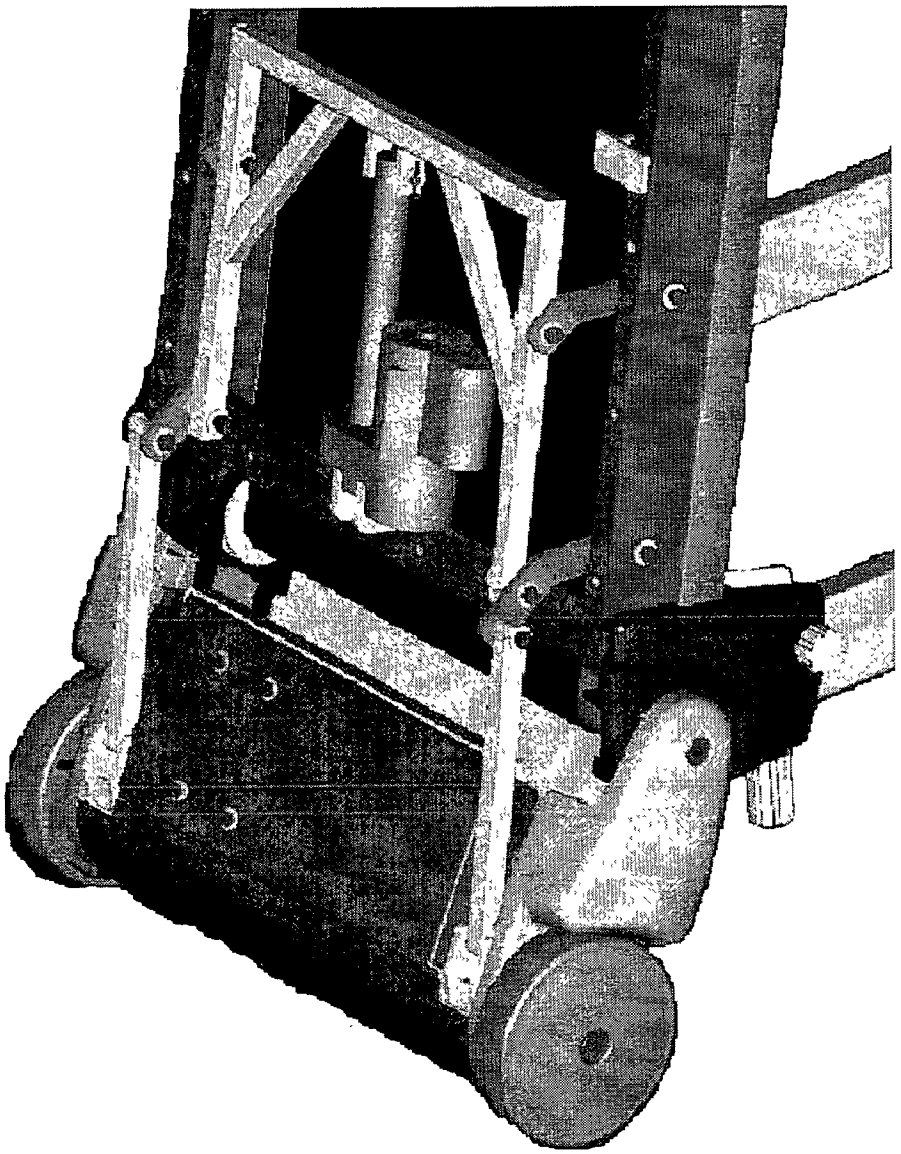
FIG. 19 is a bottom fragmentary perspective view of the underside of the treadmill with the cage forwardly extended such that the deck is substantially parallel to the ground upon which the treadmill rests.
Figure 20:
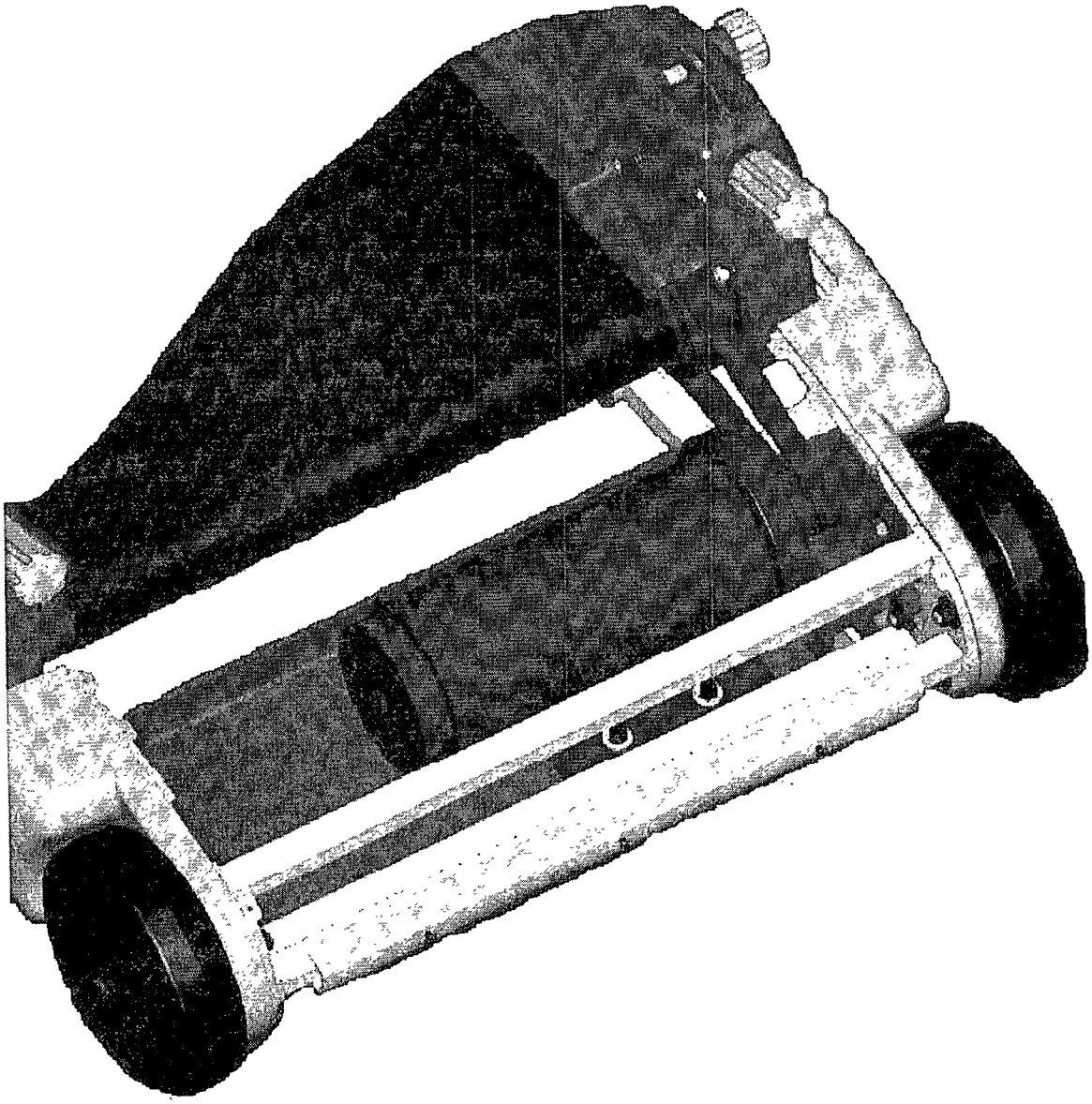
FIG. 20 is a top fragmentary perspective view of the of the cage with its cover or shroud removed to expose a treadmill belt drive carried by the cage.

FIGS. 17-20 illustrate operation of the incline drive arrangement to change the incline of the treadmill 20*b*. FIG. 17 illustrates the linear actuator driving the swing arm toward the front of the treadmill causing the drive carriage to pivot counterclockwise away from the bottom of the treadmill. This causes the incline of the treadmill deck to increase. FIG. 18 depicts further displacement of the linear actuator in the same direction further pivoting the drive carriage in a counterclockwise direction. As the carriage moves past perpendicular relative to the treadmill frame rails, where the angle of inclination is a maximum, the angle of inclination begins to decrease. In a preferred method, with the drive carriage disposed substantially perpendicularly relative to the treadmill frame rails but at an acute angle relative to the rails within about ten degrees of perpendicular, the carriage is disposed in a storage position such that the treadmill can be stood uprightly, such as in the manner shown in FIG. 30, with it being self-supported in the upright position on the drive carriage. FIG. 19 illustrates further displacement of the linear actuator in a direction that further extends the carriage in a counterclockwise direction. FIG. 20 depicts this same carriage position with the cover of the carriage removed for clarity.

FIGS. 21-26 depict the sequence of folding the console and stanchions of the treadmill into a storage or shipping position. FIGS. 27-30 depict raising the treadmill into a generally upright storage position such that it rests on its drive carriage.

Figure 21:
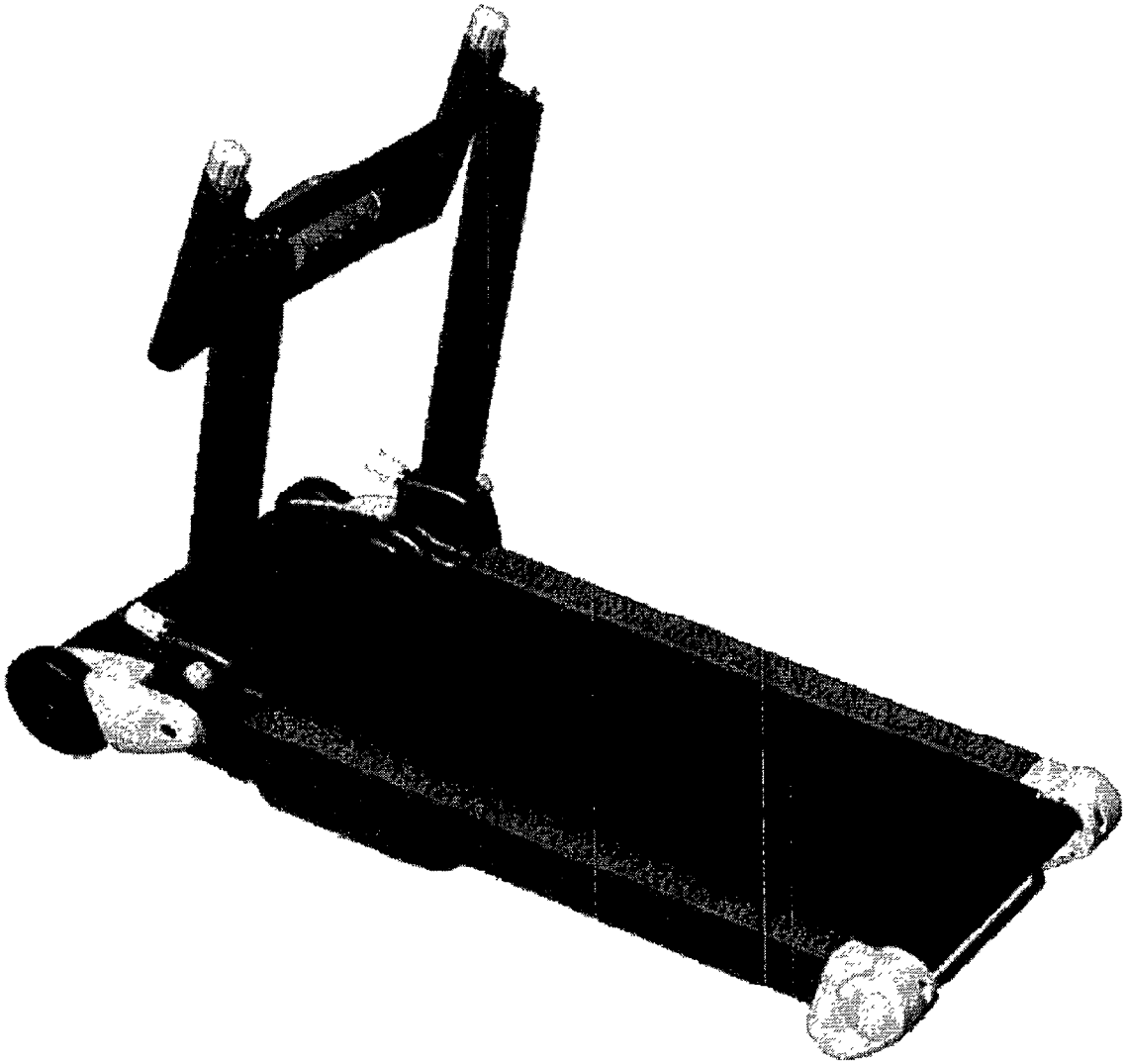
FIG. 21 is a perspective view of the treadmill with its console folding toward its handrails.
Figure 22:
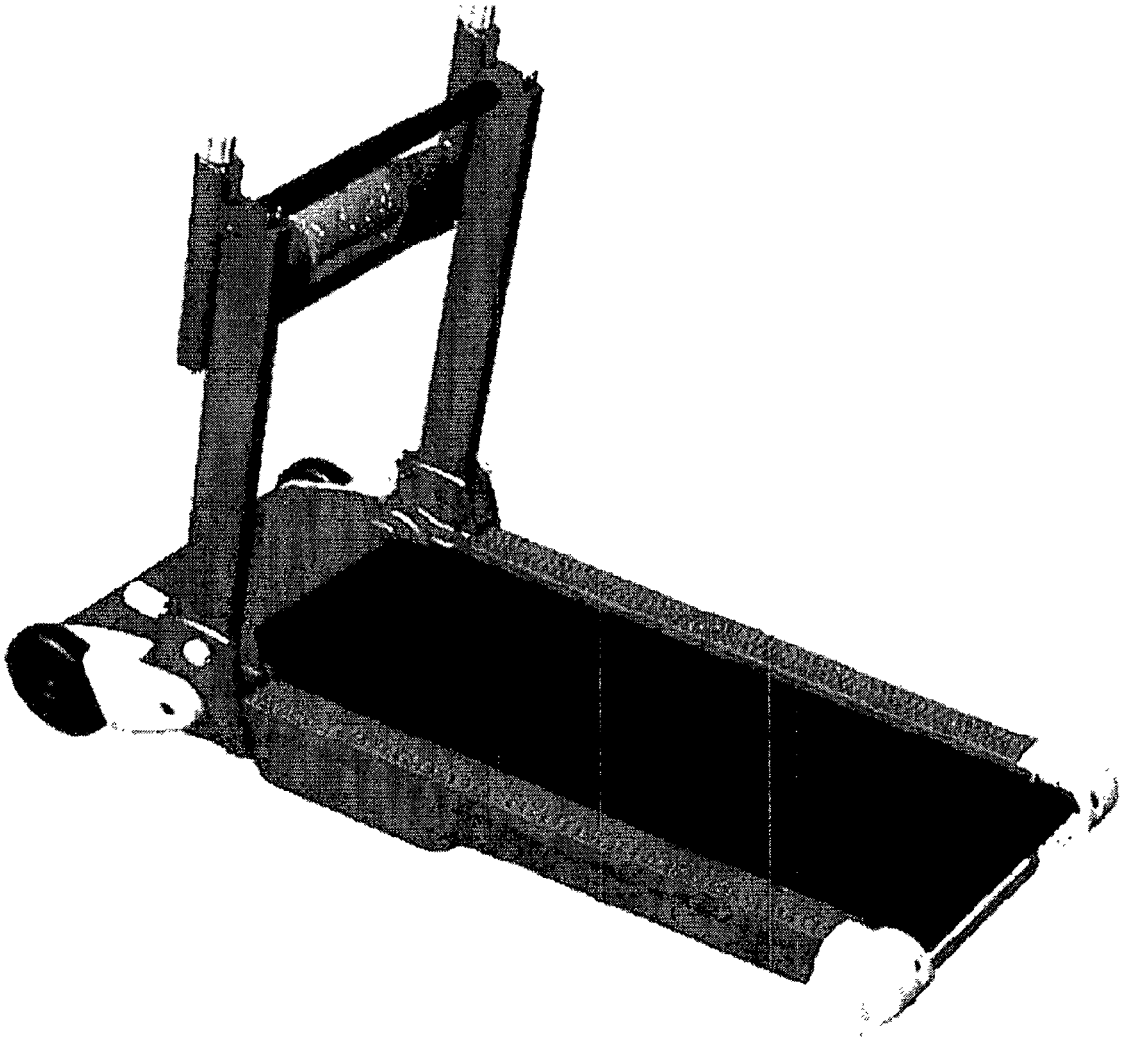
FIG. 22 is a perspective view of the treadmill with its console folded against its handrails.
Figure 23:
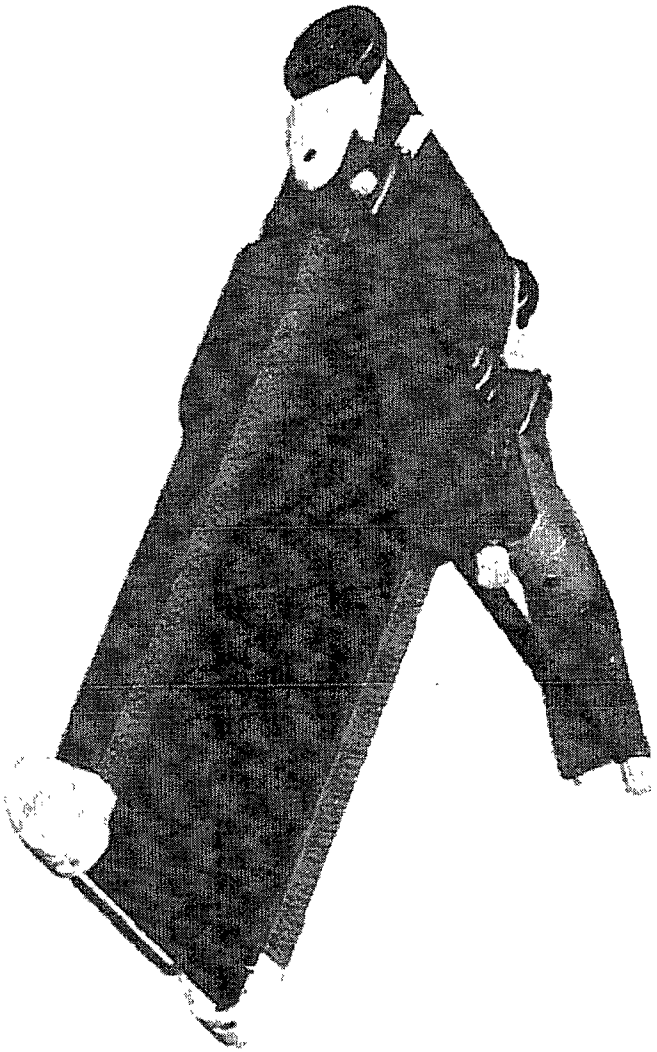
FIG. 23 is a perspective view of the treadmill with its console folded against it handrails and its handrails folding toward the treadmill deck.
Figure 24:
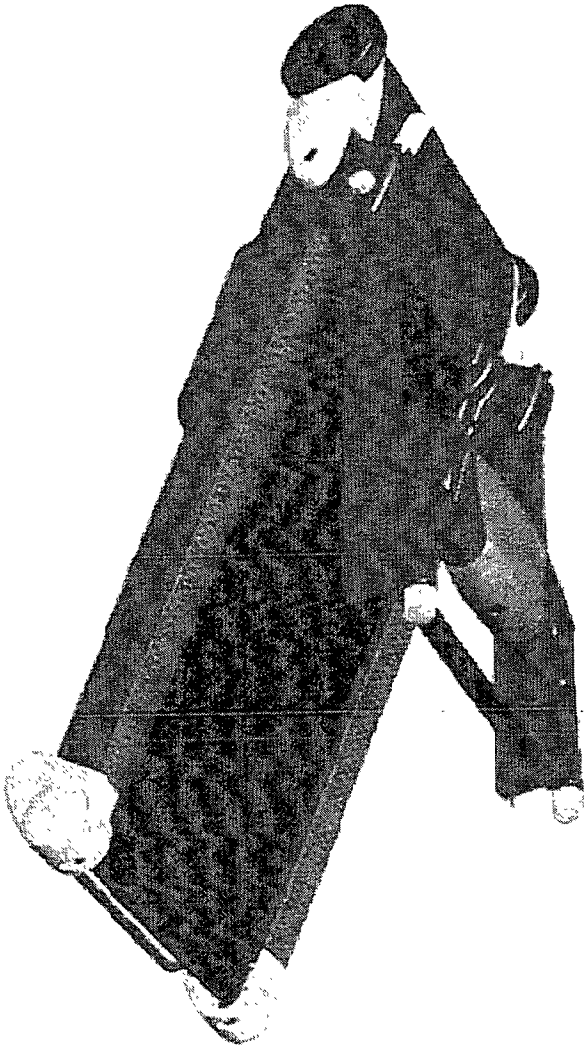
FIG. 24 is a perspective view of the treadmill being folded.
Figure 26:
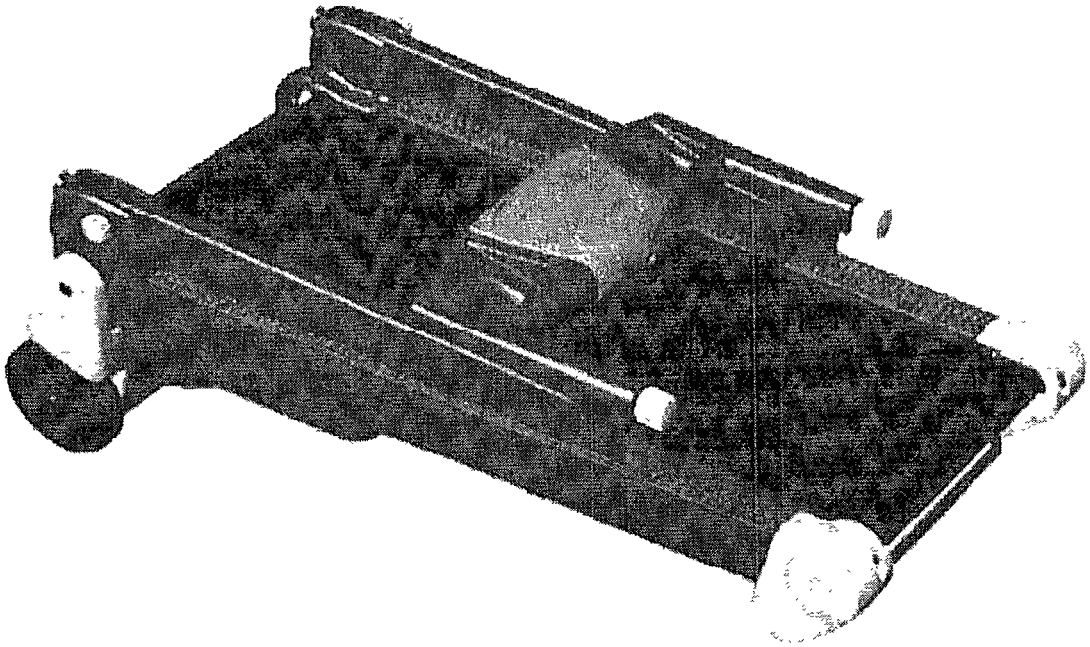
FIG. 26 is a perspective view of the treadmill in a folded state with the cage being drawn toward the frame rails of the treadmill frame toward a position that enables the treadmill to be lifted and stored upright on the cage.
Figure 25:
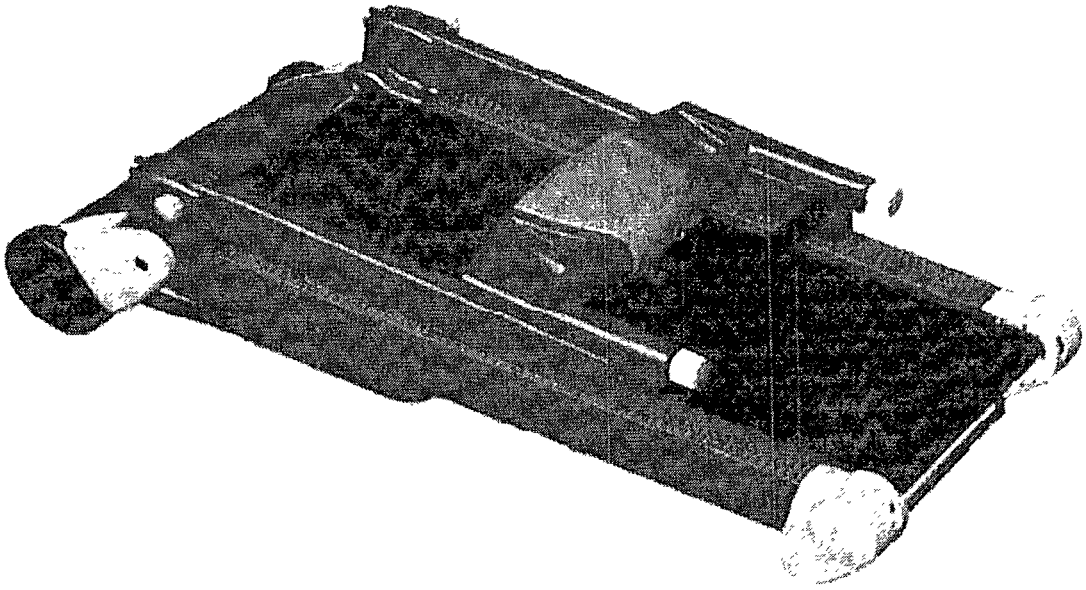
FIG. 25 is a perspective view of the treadmill with its handrails folded against the treadmill deck and the console folded against its handrails.

FIG. 9 illustrates the treadmill with the stanchions and console in an operational position. FIG. 21 illustrates the console being folded. To release the console so it can be folded, the knob along each side of the console is rotated to loosen it until the consol can be pivoted forwardly. FIG. 22 depicts the console folded against the handrails. FIGS. 23 and 24 illustrate the handrails being folded toward the deck of the treadmill. To permit the handrails to be folded, the knob attached to each front frame rail end cap is loosened to release its corresponding handrail. Each handrail pivots about its point of attachment to its respective front frame rail end cap. FIG. 25 illustrates the treadmill in a folded condition with the handrails folded against the treadmill deck and the console folded against the handrails. FIG. 26 illustrates the swing cage in a storage position where it is nearly perpendicular to the treadmill deck.

Figure 27:
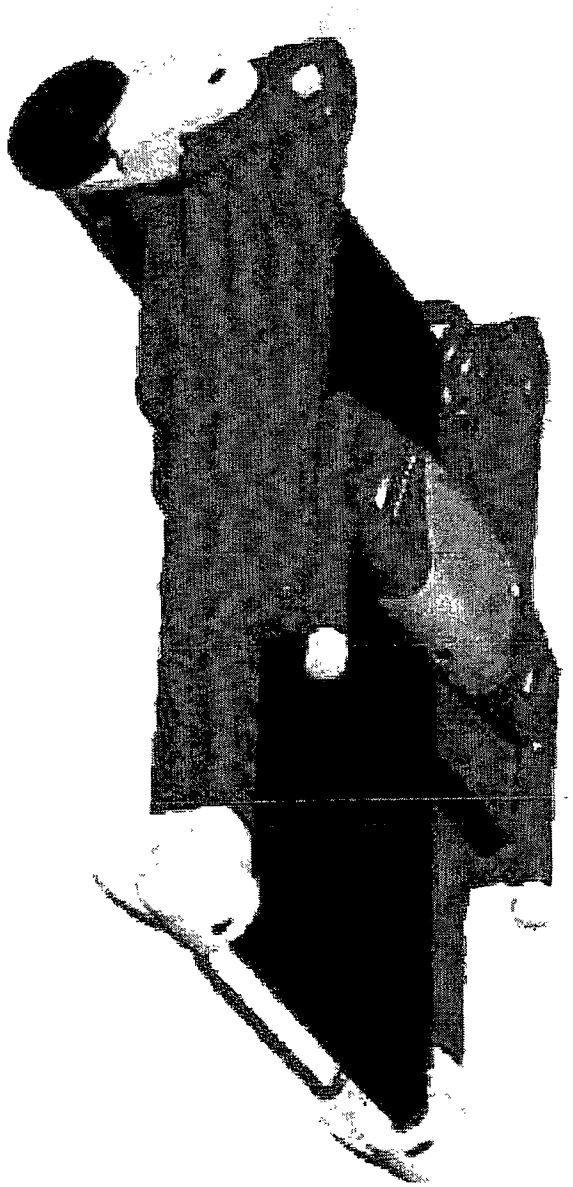
FIG. 27 is a perspective view of the treadmill of FIG. 26 with the treadmill deck being lifted upwardly about the cage.
Figure 28:
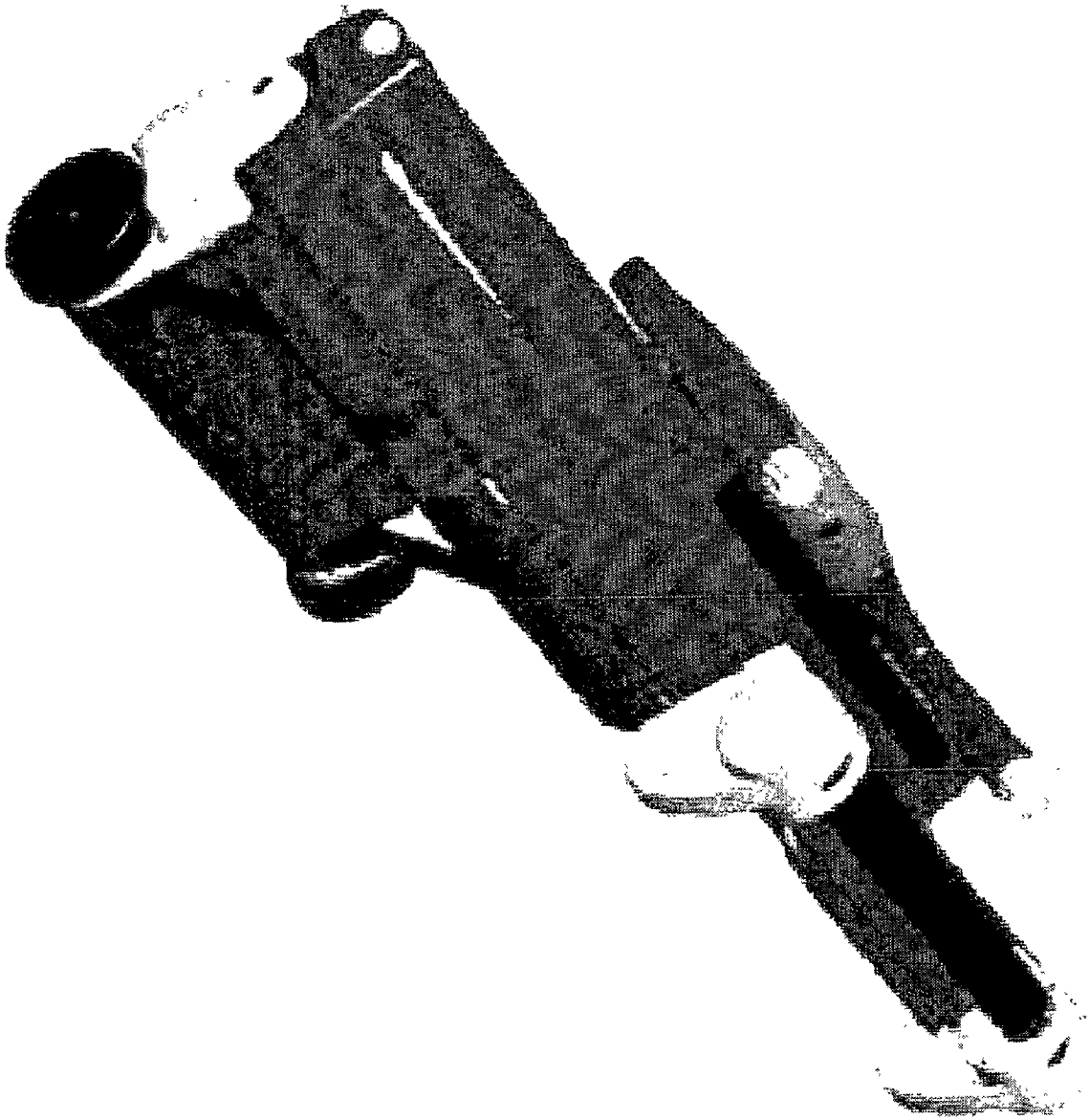
FIG. 28 is a perspective view of the treadmill of FIG. 27 being lifted further vertically.
Figure 29:
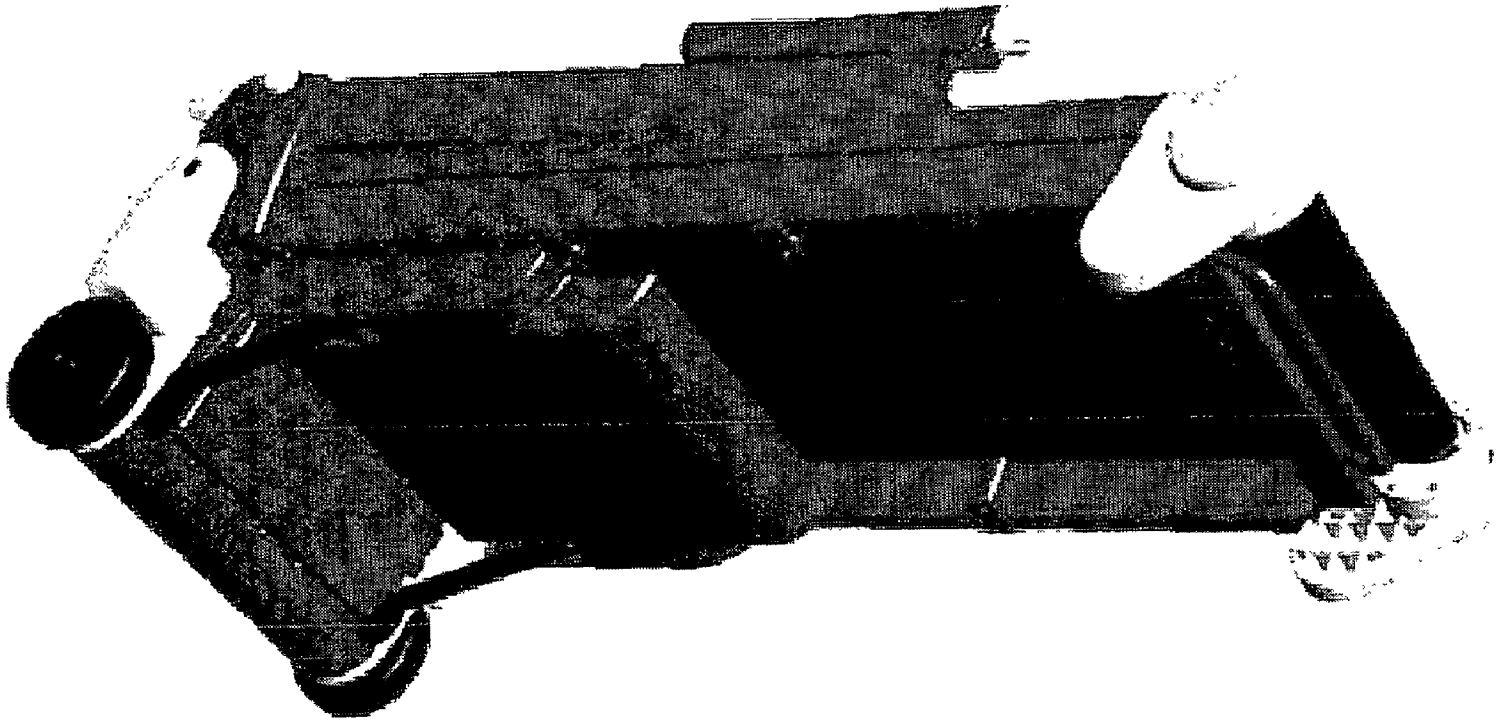
FIG. 29 is perspective view of the treadmill in a storage position resting generally upright on its cage.

After that, a cross brace at the rear of the deck is grasped as a handle and the rear of the deck is raised. In a preferred embodiment, and as is shown in FIG. 27, a handle extends outwardly from the cross brace. The entire treadmill pivots about its wheels, which are still in contact with the ground. FIG. 28 illustrates the rear of the deck of the treadmill being lifted even higher. Referring to FIG. 29, when lifted high enough, the treadmill is self-supporting in an upright position, such as is shown. In a preferred storage position, the treadmill rests on its swing cage and the knobs that permit pivoting and locking of the handrails. As a result of its advantageous construction the treadmill can self-support itself in an upright position for storage without taking up a great deal of space. If desired, the treadmill can be leaned against a wall with it resting upright on its swing cage and against the wall.

It is understood that the various preferred embodiments are shown and described above to illustrate different possible features of the invention and the varying ways in which these features may be combined. Apart from combining the different features of the above embodiments in varying ways, other modifications are also considered to be within the scope of the invention.

The invention is not intended to be limited to the preferred embodiments described above, but rather is intended to be limited only by the claims set out below. Thus, the invention encompasses all alternate embodiments that fall literally or equivalently within the scope of these claims.

What is claimed is:

1. A treadmill comprising:

(a) a frame;

(b) a movable treadmill belt carried by a deck that is supported by the frame;

(c) a swing cage pivotally attached to the frame that extends outwardly from the frame and that is extendable forwardly of the frame, spacing the frame and treadmill belt above a floor during treadmill operation, wherein the swing cage is configured to be pivotally movable relative to the deck and a user support surface of the treadmill belt to change a tilt of the deck relative to the floor between one position where the swing cage forms an obtuse angle with the frame and another position where the swing cage forms an acute angle with the frame enabling the frame to be stood uprightly on the swing cage;

(d) a treadmill belt drive carried by the swing cage enabling movement of the treadmill belt with the treadmill belt drive spaced from the treadmill belt providing a walk-through treadmill arrangement wherein a top surface of the treadmill belt is unobstructed along a longitudinal direction from a front of the treadmill belt to a rear of the treadmill belt; and (e) a swing cage drive in operable cooperation with the swing cage enabling pivotable movement of the swing cage.

2. The treadmill of claim 1 wherein the swing cage includes a plurality of spaced apart arms that space one end of the deck off the floor with the swing cage being pivotable toward one of the frame and the deck in increasing or decreasing the tilt of the deck and wherein the swing cage drive is mounted to one of the frame and the swing cage.

3. The treadmill of claim 1 wherein the treadmill belt is of flexible endless construction, the swing cage includes a plurality of spaced apart arms that space one end of the deck off the floor with one end of each one of the arms pivotally attached to the frame and the other end of each one of the arms comprising a foot or wheel that rests on the floor, the swing cage includes a cross brace extending between the arms, the treadmill belt is movably supported at its front by a front roller carried by the frame and at its rear by a rear roller carried by the frame, and the treadmill belt drive comprises an electric motor mounted to the swing cage that is coupled by a belt to the front roller.

4. The treadmill of claim 3 wherein the swing cage drive comprises a second electric motor that is configured to drive a worm gear.

5. The treadmill of claim 1, wherein said treadmill belt drive comprises a belt drive motor carried by the swing cage and wherein the swing cage is pivotable between an angle of no greater than about 180° to about 90° relative to the frame and the deck.

6. A treadmill comprising:

(a) a frame comprised of a pair of elongate, spaced apart, generally parallel, and lengthwise extending frame rails each having a front end and a rear end;

(b) a pair of rear end caps that each have an integral frame rail receiving recess, an integral footrest, and an integral roller hub, wherein one of the rear end caps is fixed to one of the frame rails at or adjacent the rear end of the one of the frame rails and wherein the other one of the rear end caps is fixed to the other one of the frame rails at or adjacent the rear end of the other one of the frame rails;

(c) a pair of front end caps that each have an integral roller hub and an integral stanchion mounting recess wherein one of the front end caps is fixed to one of the frame rails at or adjacent the front end of the one of the frame rails and wherein the other one of the front end caps is fixed to the other one of the frame rails at or adjacent the front end of the other one of the frame rails;

(d) a pair of generally parallel treadmill-belt supporting rollers disposed between the frame rails with (1) one of the treadmill-belt supporting rollers disposed at or adjacent the rear end of the frame rails having one roller end rotatively supported by a bearing carried by the roller hub of one of the rear end caps and having the other roller end rotatively supported by a bearing carried by the roller hub of the other one of the rear end caps and (2) the other one of the treadmill-belt supporting rollers disposed at or adjacent the front end of the frame rails having one roller end rotatively supported by a bearing carried by the roller hub of one of the front end caps and having the other roller end rotatively supported by a bearing carried by the roller hub of the other one of the front end caps;

(e) a movable belt supported by a deck disposed between the frame rails and carried by the treadmill-belt supporting rollers;

(f) a swing cage pivotally attached to the frame and having a front end disposed forwardly of the deck with said swing cage pivotally movable relative to both the deck and the frame enabling changing of an angle of inclination between a user support surface of the treadmill belt and a floor upon which the treadmill rests, wherein the swing cage comprises a plurality of spaced apart arms each of which has one end pivotally coupled to one of the frame rails and the other end comprising a foot resting on the floor;

(g) a treadmill belt drive operably coupled to the treadmill belt moving the treadmill belt when energized with the treadmill belt drive carried by the swing cage;

(h) a pair of uprightly disposable stanchions with one of the stanchions having an end connected to one of the front end caps and the other one of the stanchions having an end connected to the other one of the front end caps; and (i) wherein the treadmill is of walk-through construction with the user support surface of the treadmill belt being unobstructed along the lengthwise direction of the treadmill from a front of the treadmill belt to a rear of the treadmill belt.

7. The treadmill of claim 6, wherein the treadmill belt drive comprises an electric motor carried by the swing cage and disposed between the swing cage arms that drives the belt and wherein the swing cage arms are each pivotally connected to a corresponding one of the front end caps such that the user support surface of the treadmill belt is selectively inclinable by pivoting the swing cage to change the angle of the user support surface of the treadmill relative to the floor.

8. A method of operating a treadmill comprising:

(a) providing a treadmill including:

(1) a frame, (2) a deck carried by the frame and which supports an endless flexible treadmill belt, (3) a swing cage pivotally attached to the frame, wherein the swing cage is configured to pivotally move to change a tilt of the belt relative to a floor with said swing cage movable relative to both the deck and the floor and carrying a treadmill belt drive spaced from the treadmill belt in a manner that provides a walk-through treadmill arrangement such that the treadmill belt is unobstructed in a longitudinal direction from a front of the treadmill belt adjacent a front of the treadmill to a rear of the treadmill belt adjacent a rear of the treadmill, (4) a tilt drive that cooperates with the swing cage to pivot the swing cage when operated, and (5) wherein the treadmill belt drive comprises an electric motor that has a rotary output shaft that drives the treadmill belt relative to the frame during electric motor operation;

(b) operating the tilt drive to pivot the swing cage to change the tilt of the treadmill belt relative to the floor; and (c) operating the treadmill belt drive motor to move the treadmill belt relative to the frame; and wherein during step (b) the tilt drive is operated to pivot the swing cage the swing cage is disposed at an angle relative to the frame and the deck such that the treadmill can be stood uprigthly on the swing cage.

9. The method of claim 8, wherein the tilt drive comprises a tilt motor and wherein the swing cage further comprises:

(A) a drive shaft connected to the tilt motor, (B) a worm gear that is connected to the drive shaft of the tilt motor, and (C) a helical gear that engages the worm gear and that is connected to a main drive shaft; and wherein operating the tilt motor comprises at least one of:

rotating the worm gear in a first direction such that engagement between the helical gear and the worm gear causes the swing cage to pivot toward the frame and the deck changing the tilt of the frame and deck relative to the floor; and rotating the worm gear in a second direction such that engagement between the helical gear and the worm gear causes the swing cage to pivot away the frame and the deck changing the tilt of the frame and deck relative to the floor.

10. The method of claim 8, wherein during step (b) the tilt drive is operated to pivot the swing cage until the swing cage is disposed at an angle of about 90° relative to the frame and the deck such that the treadmill can be stood uprightly on the swing cage with the treadmill frame extending upwardly away from the floor.

11. The method of claim 8, wherein the tilt drive comprises an electric motor in operable cooperation with the swing cage and the frame with operation of the electric tilt drive motor in step (b) causing the tilt of the treadmill belt relative to the floor to be selectively changed by changing an angle of the swing cage relative to the treadmill frame.

12. The method of claim 11, wherein operating the tilt motor in step (b) includes the steps of:

rotating a worm gear such that engagement between a helical gear and the worm gear causes the swing cage to pivot relative to the frame and the deck until the swing cage is disposed at an angle of less than about 90° relative to the deck and within about 10° thereof locating the swing cage in a treadmill storage position enabling the deck and frame to be supported generally uprightly thereon; and with the swing cage disposed in a treadmill storage position, manually grasping and lifting the end of the frame opposite the swing cage and moving the treadmill from a first location on the floor to a second location on the floor with the swing cage in contact with the floor.

13. The method of claim 12, wherein the frame of the treadmill is lifted until the treadmill uprightly self-supports itself on the swing cage.

14. A method of operating a treadmill comprising:

(a) providing a treadmill including (1) a frame, (2) a deck carried by the frame that supports a treadmill belt that is movable relative to the deck, (3) a swing cage pivotally attached to the frame and the deck and extending forwardly of the deck such that the swing cage forms an obtuse angle with the deck when the swing cage is in a treadmill operating position with the swing cage pivotally movable relative to both the deck and a floor and carrying a treadmill belt drive spaced from the belt producing a walk-through treadmill arrangement, wherein the swing cage is configured to pivotally move to change a tilt of the frame and the deck relative to the floor, (4) wherein the treadmill belt drive comprises an electric motor carried by the swing cage that has a rotary output drive shaft that is rotated during treadmill operation to drive the treadmill belt to move the treadmill belt relative to the deck, and (5) a tilt motor that is configured to pivot the swing cage relative to the deck; and (b) adjusting an angle of inclination of the deck relative to the floor upon which the treadmill rests by operating the tilt motor until the swing cage pivots from a treadmill operating position to a treadmill storage position where the swing cage forms an acute angle with the deck; and thereafter (c) standing the treadmill uprightly on the swing cage such that the frame of the treadmill extends generally vertically.

15. The method of claim 14, wherein the tilt motor is carried by the frame and is configured to cooperate with the swing cage to controllably pivot the swing cage relative to the deck to vary the inclination of the deck and the frame relative to the floor while the deck is in an operational position and wherein the tilt motor is operated in step (b) to pivot the swing cage so it forms an acute angle with the deck that is within about ten degrees of perpendicular relative thereto.

16. A treadmill comprising:

(a) a frame comprising a pair of spaced apart, generally parallel and elongate fore-aft extending frame rails;

(b) a pair of spaced apart rollers disposed transversely between the frame rails;

(c) a movable treadmill belt carried by the rollers;

(d) a swing cage pivotally coupled to the frame rails with the swing cage extending forwardly and outwardly from the frame rails spacing the frame rails and belt adjacent the front of the frame above a floor upon which the treadmill rests wherein pivotable movement of the swing cage relative to the frame rails changes an angle of inclination of a top surface of the treadmill belt relative the floor;

(e) a treadmill belt drive carried by the swing cage that is in operable communication with the treadmill belt for moving the belt during operation;

(f) a plurality of frame rail end caps that each are mounted to one end of one of the frame rails with each frame rail end cap comprising a recess for receiving one end of the one of the frame rails therein, an integral footrest, and an integral roller hub; and wherein each one the frame rail end caps is mounted to a rear end of one of the frame rails, and further comprising a deck that supports the treadmill belt and a brace that underlies the deck adjacent the rear of the treadmill, which extends from one of the frame rail end caps that is mounted to the rear end of the frame rails to the other one of the frame rail end caps that is mounted to the rear end of the other one of the frame rails, and which functions as a handle that can be grasped to either lift the rear of the treadmill or to move the treadmill.

17. The treadmill of claim 16, wherein the integral roller hub of each frame rail end cap is constructed and arranged to receive and rotatively support one end of one of the rollers.

18. A treadmill comprising:

(a) a frame comprising a pair of spaced apart, generally parallel and elongate, fore-aft extending frame rails;

(b) a pair of spaced apart rollers disposed transversely between the frame rails;

(c) a movable endless flexible treadmill belt carried by the rollers;

(d) a generally planar deck disposed between the frame rails and between the rollers that supports the treadmill belt;

(e) a swing cage pivotally carried by the frame rails with the swing cage extending forwardly and outwardly from the frame rails spacing the frame rails and belt adjacent the front of the frame above a floor upon which the treadmill rests wherein pivotable movement of the swing cage relative to the frame rails changes an angle of inclination of a top surface of the treadmill belt relative the floor;

(f) an electric treadmill belt drive motor carried by the swing cage that is in operable communication with the treadmill belt for moving the belt during operation;

(g) a pair of spaced apart and upstanding stanchions; and (h) a plurality of frame rail end caps that each are mounted to a front end of each one of the frame rails with each frame rail end cap comprising a roller hub that rotatively supports one end of a corresponding one of the rollers and a pocket for receiving one end of a corresponding one of the stanchions therein.

19. The treadmill of claim 18, further comprising a bearing that is mounted to the roller hub of each one of the frame rail end caps wherein one end of one of the rollers is rotatively supported by the bearing mounted to the roller hub of one of the frame rail end caps and the other end of the one of the rollers is rotatively supported by the bearing mounted to the roller hub of the other one of the frame rail end caps.

20. The treadmill of claim 18, wherein each one of the stanchions is pivotally mounted to one of the frame rail end caps.

21. A treadmill comprising:

(a) a frame comprising a plurality of spaced apart and longitudinally extending frame rails;

(b) a plurality of spaced apart rollers disposed transversely between the frame rails;

(c) an endless flexible belt: carried by the rollers, having a front region and a back region;

(d) a swing cage that carries an electric treadmill belt drive motor and that comprises a cage housing the electric treadmill belt drive motor that includes a plurality of spaced apart and longitudinally extending arms that are each pivotally operatively connected at one end or adjacent to a different one of the frame rails and which each extends forwardly beyond the front region of the treadmill belt and which operatively communicate at the other end with a floor on which the treadmill rests, at least one transversely extending cross brace that extends between the plurality of arms adjacent the other end of the arms, and a housing mounted to the swing cage having at least a portion that overlies the electric treadmill belt drive motor and that is configured not to obstruct any portion of the treadmill belt at or adjacent the front of the treadmill belt providing a walk-through arrangement;

(e) a pair of spaced apart and upstanding stanchions; and (f) a plurality of the frame rail end caps that each are mounted to a front end of one of the frame rails with each frame rails end cap comprising (1) a roller hub that carrier a bearing in which one end of one of the rollers is rotatively received, (2) a pocket for receiving one end of one of the stanchions therein, and (3) a mounting surface to which one end of one of the arms of the swing cage is pivotally mounted; and wherein the electric treadmill belt drive motor has a transversely oriented rotary output shaft with the electric treadmill belt drive motor transversely disposed between the swing cage arms and wherein rotation of the electric treadmill drive rotary output shaft moves the treadmill belt over the rollers during treadmill operation.

22. The treadmill of claim 21, wherein the electric treadmill belt drive motor rotary output shaft is coupled by a belt to one of the rollers such that rotation of the electric treadmill belt drive motor rotary output shaft rotates the one of the rollers moving the treadmill belt.

23. The treadmill of claim 21, further comprising a wheel attached to a free end of each arm of the swing cage.

24. The treadmill of claim 21, wherein the swing cage also serves as a base for the frame to rest upon when the treadmill is folded for storage with its deck in an upright position.

25. The treadmill of claim 21, further comprising a pair of rollers disposed between the frame rails on which the belt is supported, and wherein the drive comprises an electric motor having an output shaft that is coupled by an endless flexible member to one of the rollers.

26. The treadmill of claim 21, further comprising means for controlling the angle of the swing cage relative to the frame of the treadmill to thereby control an angle of inclination of the deck of the treadmill.

27. The treadmill of claim 26, wherein the swing cage angle controlling means comprises a linear actuator mounted to the frame that is pivotally coupled by a linkage arrangement to the swing cage.

28. The treadmill of claim 26, wherein the swing cage angle controlling means comprises an electric motor carried by the swing cage that has an output shaft to which a first gear is mounted that engages a second gear that is connected to the frame.

29. A treadmill comprising:

a pair of generally parallel and elongate frame rails;

a plurality of spaced apart rollers transversely disposed interjacent the frame rails with one of the rollers disposed adjacent a front of the treadmill and another one of the rollers disposed adjacent a rear of the treadmill;

an endless flexible belt movably carried by the rollers;

a pair of frame rail rear end caps with one of the rear end caps receivable over a rear end of one of the frame rails to which the rear end cap is mounted and the other one of the rear end caps receivable over a rear end of the other one of the frame rails to which the rear end cap is mounted, wherein one end of the rear roller is rotatively supported by one of the rear end caps and the other end of the rear roller is rotatively supported by the other one of the rear end caps, and wherein each rear end cap comprises an integral foot extending outwardly upon which the rear of the treadmill is supported;

a pair of frame rail front end caps with one of the front end caps receivable over a front end of one of the frame rails to which the front end cap is mounted and the other one of the front end caps receivable over a front end of the other one of the frame rails to which the front end cap is mounted, wherein one end of the front roller is rotatively supported by one of the front end caps and the other end of the front roller is rotatively supported by the other one of the front end caps, and wherein each front end cap comprises a mount;

a forwardly extending pivotable subframe comprised of a pair of generally parallel arms, one arm of which is pivotally attached at one end or adjacent to the mount of one front end cap and that carries a wheel at its other end or adjacent to its other end, and the other arm of which is pivotally attached at or adjacent one end to the mount of the other front end cap and that carries a wheel at or adjacent its other end;

a treadmill belt drive that displaces the endless flexible belt when the belt drive is actuated; and a subframe drive that pivots the subframe relative to the frame rails when the subframe drive is actuated enabling an angle of inclination of the belt to be changed.

* * * * *